US010926905B2

(12) United States Patent
Wolf et al.

(10) Patent No.: US 10,926,905 B2
(45) Date of Patent: Feb. 23, 2021

(54) VERTICAL FORM, FILL AND SEAL MACHINE WITH ULTRASONIC VERTICAL SEAL AND RECLOSABLE FASTENER ATTACHMENT

(71) Applicant: Triangle Package Machinery Co., Chicago, IL (US)

(72) Inventors: Michael T. Wolf, Chicago, IL (US); Vadim Lubezny, Buffalo Grove, IL (US)

(73) Assignee: Triangle Package Machinery Co., Chicago, IL (US)

( * ) Notice: Subject to any disclaimer, the term of this patent is extended or adjusted under 35 U.S.C. 154(b) by 183 days.

(21) Appl. No.: 16/133,167

(22) Filed: Sep. 17, 2018

(65) Prior Publication Data

US 2019/0084710 A1 Mar. 21, 2019

Related U.S. Application Data

(60) Provisional application No. 62/560,942, filed on Sep. 20, 2017.

(51) Int. Cl.

| | |
|---|---|
| ***B65B 51/16*** | (2006.01) |
| ***B65B 9/087*** | (2012.01) |
| ***B65B 51/22*** | (2006.01) |
| ***B65B 51/30*** | (2006.01) |
| ***B65B 61/18*** | (2006.01) |
| ***B65B 9/20*** | (2012.01) |
| ***B65B 51/26*** | (2006.01) |

(52) U.S. Cl.

CPC ..... *B65B 51/16* (2013.01); *B65B 9/087* (2013.01); *B65B 9/20* (2013.01); *B65B 51/225* (2013.01); *B65B 51/26* (2013.01); *B65B 51/30* (2013.01); *B65B 61/188* (2013.01)

(58) Field of Classification Search

CPC ..... B65B 51/00; B65B 51/16; B65B 51/22; B65B 51/225; B65B 51/26; B65B 61/18; B65B 61/188; B65B 9/087

USPC ..... 53/139.1, 139.2

See application file for complete search history.

(56) References Cited

U.S. PATENT DOCUMENTS

| | | | | |
|---|---|---|---|---|
| 4,517,790 | A | 5/1985 | Kreager | |
| 4,757,668 | A | 7/1988 | Klinkel et al. | |
| 5,400,568 | A * | 3/1995 | Kanemitsu | B29C 59/007 493/213 |
| 6,047,521 | A | 4/2000 | Terminella et al. | |

(Continued)

FOREIGN PATENT DOCUMENTS

WO WO2017/093488 A1 6/2017

OTHER PUBLICATIONS

Basic Components of a Rotary Ultrasonic System | Aurizon Ultrasonics: https://aurizonultrasonics.com/basic-components-of-a-rotary-ultrasonic-system/ dated Sep. 5, 2017; 4 pgs.

(Continued)

*Primary Examiner* — Chelsea E Stinson

(74) *Attorney, Agent, or Firm* — Brinks Gilson & Lione

(57) ABSTRACT

A vertical form, fill and seal machine for making a reclosable package with a reclosable fastener includes a reclosable fastener handling assembly, a forming tube, a vertical seal assembly and a sealing jaw assembly. The seal assembly includes a rotary ultrasonic sealing assembly having a rotary horn and at least one rotary anvil.

21 Claims, 22 Drawing Sheets

(56) References Cited

U.S. PATENT DOCUMENTS

| | | | | |
|---|---|---|---|---|
| 6,537,403 | B1 | 3/2003 | Blenke et al. | |
| 6,896,950 | B2 | 5/2005 | Forman et al. | |
| 8,539,741 | B2 * | 9/2013 | Lubezny | B29C 65/02 53/451 |
| 8,720,168 | B2 | 5/2014 | Kamigaito et al. | |
| 9,090,021 | B2 | 7/2015 | Cham et al. | |
| 9,662,829 | B2 * | 5/2017 | Hull | B29C 65/08 |
| 2002/0189206 | A1 | 12/2002 | Capodieci | |
| 2003/0093971 | A1 * | 5/2003 | Terminella | B29C 66/8161 53/133.4 |
| 2007/0028564 | A1 * | 2/2007 | Ausnit | B65D 33/2591 53/412 |
| 2011/0005172 | A1 * | 1/2011 | Miyahara | B65B 9/20 53/455 |
| 2015/0274337 | A1 | 10/2015 | Beauvy et al. | |
| 2016/0288407 | A1 | 10/2016 | Ehlert et al. | |
| 2018/0093444 | A1 | 4/2018 | Begrow et al. | |

OTHER PUBLICATIONS

International Search Report and Written Opinion for International Application No. PCT/US2018/050867 dated Dec. 6, 2018 (9 pgs).

* cited by examiner

VERTICAL FORM, FILL AND SEAL MACHINE WITH ULTRASONIC VERTICAL SEAL AND RECLOSABLE FASTENER ATTACHMENT

This application claims the benefit of U.S. Provisional Application No. 62/560,942, field Sep. 20, 2017, the entire disclosure of which is hereby incorporated herein by reference.

FIELD OF THE INVENTION

The present disclosure relates generally to a vertical form, fill and seal (VFFS) machine, and in particular to a VFFS machine having an ultrasonic vertical seal and reclosable fastener attachment device, together with a method of forming packages on the VFFS machine.

BACKGROUND

Vertical form, fill and seal bag machines are configured to form packages of different shapes and sizes. Typically, the machine, in sequence, forms a tube from a roll of film and fills the tube with a product, for example a food product. A cross seal mechanism sequentially makes a cross seal, which simultaneously forms a top seal of one bag and a bottom seal of an immediately adjacent bag, such that the latter bag may be filled with the product. The cross seal is then cut to separate the bags.

Typically, form, fill and seal machines may run intermittently, wherein the formed bag is momentarily stopped for sealing and/or cutting, or continuously, wherein the sealing jaws and cutting knife travel with the formed bag to form the seal and separate the bags. In some applications, reclosable fasteners are applied to the bag. The reclosable fasteners may be applied in the machine or transverse directions, typically on intermittent machines.

SUMMARY

The present invention is defined by the following claims, and nothing in this section should be considered to be a limitation on those claims.

In one aspect, one embodiment of a vertical form, fill and seal machine for making a reclosable package includes a vertically oriented forming tube configured to receive a film and form a film tube and a rotary ultrasonic horn disposed adjacent the forming tube, wherein the rotary ultrasonic horn is rotatable about a first horizontal axis and has a first circumferential surface. A rotary ultrasonic anvil is disposed adjacent the forming tube, wherein the rotary ultrasonic anvil is rotatable about a second horizontal axis. The rotary ultrasonic anvil has a second circumferential surface spaced apart from the first circumferential surface and forms a gap dimensioned to receive opposite edge portions of the film tube. An actuator applies a force to the rotary ultrasonic anvil, or to both the rotary ultrasonic horn and rotary ultrasonic anvil (and/or the horn), to move the rotary ultrasonic anvil toward the rotary ultrasonic horn and/or to apply a pinching force therebetween, for example to a reclosable fastener and opposite edges of a film tube. A reclosable fastener feed device is disposed upstream of the forming tube. The reclosable fastener feed device is configured to move a reclosable fastener material into the gap between opposite edges of the film tube and between the rotary ultrasonic horn and the first rotary ultrasonic anvil.

In another aspect, one embodiment of a vertical form, fill and seal machine for making a reclosable package includes a second rotary ultrasonic anvil disposed adjacent the forming tube, wherein the second rotary ultrasonic anvil is rotatable about a third horizontal axis, which may be the same as the second horizontal axis. The second rotary ultrasonic anvil has a third circumferential surface spaced apart from the first circumferential surface and forming a second gap therebetween. A second actuator applies a force to the second rotary ultrasonic anvil, or to both of rotary ultrasonic horn and second rotary ultrasonic anvil (and/or horn), to move the second rotary ultrasonic anvil toward the rotary ultrasonic horn and/or to apply a pinching force therebetween, for example to opposite edges of a film tube.

In another aspect, one embodiment of a method of forming a package with a reclosable fastener includes moving a reclosable fastener material continuously in a machine direction with a feed device, forming a film tube on a forming tube, rotating a ultrasonic horn about a first horizontal axis, rotating an ultrasonic anvil about a second horizontal axis, and sealing the reclosable fastener material to portions of opposite edges of the film tube with the rotating ultrasonic horn and ultrasonic anvil.

In yet another aspect, one embodiment of the method of forming the package with a reclosable fastener includes rotating a second ultrasonic anvil about a third horizontal axis, and sealing an outer portion of the opposite edges of the film tube with the rotating ultrasonic horn and second ultrasonic anvil.

In yet another aspect, one embodiment of a method of reconfiguring a vertical form, fill and seal machine includes providing a vertical forming tube and a sealing assembly adjacent the vertical forming tube, wherein the sealing assembly includes an ultrasonic horn rotatable about a first horizontal axis, a first ultrasonic anvil rotatable about a second horizontal axis and spaced apart from the ultrasonic horn so as to form a first gap therewith, and a second ultrasonic anvil rotatable about a second horizontal axis and spaced apart from the ultrasonic horn so as to form a second gap therewith. The method further includes removing the second ultrasonic anvil from the sealing assembly. In other embodiments, the method may further include removing and replacing the horn and first ultrasonic anvil, or reinstalling the same or different second ultrasonic anvil.

The various embodiments of the vertical form, fill and seal machines, and methods for the use thereof, provide significant advantages over other form, fill and seal machines, and components used therein. For example and without limitation, the disclosed vertical form, fill and seal machine provides for a continuous bag forming operation incorporating a reclosable fastener. Running a continuous operation provides a substantially higher output of bags, while allowing the film to travel at a lower speed. The lower film speed in turn eliminates dynamic loading of the film, and avoids skipping and other disruptions. The dual rotary ultrasonic sealer further enhances the ability to run at higher speeds. At the same time, the machine may be quickly and easily reconfigured to form bags without a reclosable fastener, or with other embodiments or types of reclosable fasteners, or bags made of different film materials.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

It should be understood that the term "plurality," as used herein, means two or more. The terms "longitudinal" and "machine" as used herein means of or relating to length or the lengthwise direction 30, and refers to the direction of film 4, film tube 12 or reclosable fastener material 40 movement through a vertical form, fill and seal machine. In this way, it should be understood that portions of the reclosable fastener material may be positioned at different angles and/or orientations relative to other portions of the reclosable fastener material upstream or downstream therefrom at any one time during the bag forming process, but with the various portions all travelling in the longitudinal or machine direction. Likewise, the film 4 and reclosable fastener material 40 may travel along separate "machine" direction paths before being joined at the vertical seal assembly. The terms "downstream" and "upstream" refer to the relative position of the film and/or reclosable fastener material as they travel from a supply roll to the final bag formation, with a component lying "upstream" from a reference point being closer to the supply roll in the process and a component lying "downstream" from the reference point being closer to the final bag formation. The terms "lateral" and "transverse" as used herein, means situated on, directed toward or running from side to side, and refers to a direction transverse to the machine direction movement of the film and reclosable fastener material through a form, fill and seal machine.

The term "coupled" means connected to or engaged with whether directly or indirectly, for example with an intervening member, and does not require the engagement to be fixed or permanent, although it may be fixed or permanent (or integral), and includes both mechanical and electrical connection. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. For example, a "first" anvil may be later referred to as a "second" anvil depending on the order in which they are referred. It should also be understood that designation of "first" and "second" does not necessarily mean that the two components or values so designated are different, meaning for example a first anvil may be the same as a second anvil, with each simply being applicable to separate but identical components.

U.S. Pat. Nos. 5,715,656, 5,752,370 and 8,539,741, and U.S. Pub. No. 2017/0113,823, assigned to Triangle Package Machinery Company, the same Assignee as the present application, disclose various components of form, fill and seal machines, the entirety of which patents and publication are hereby incorporated herein by reference.

Figure 5:
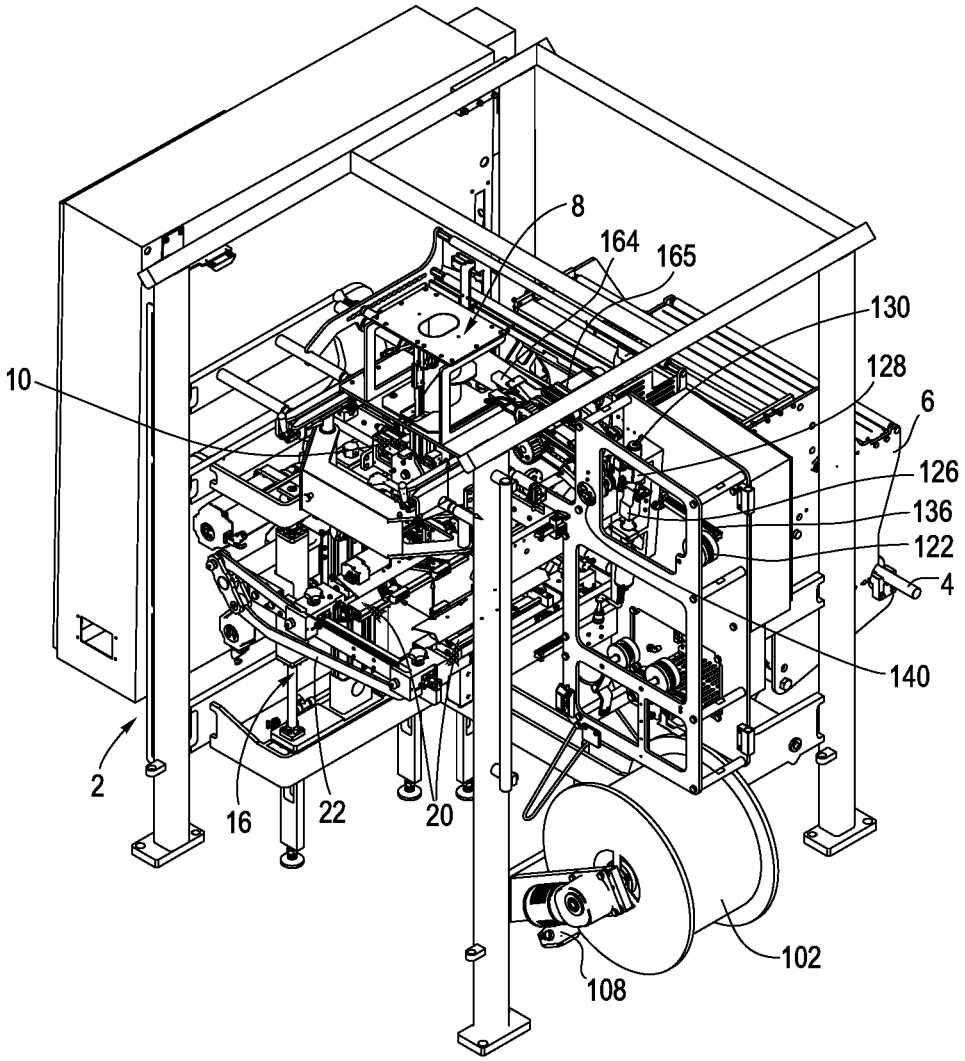
FIG. 5 is a perspective view of one embodiment of a form, fill and seal machine.
Figure 6:
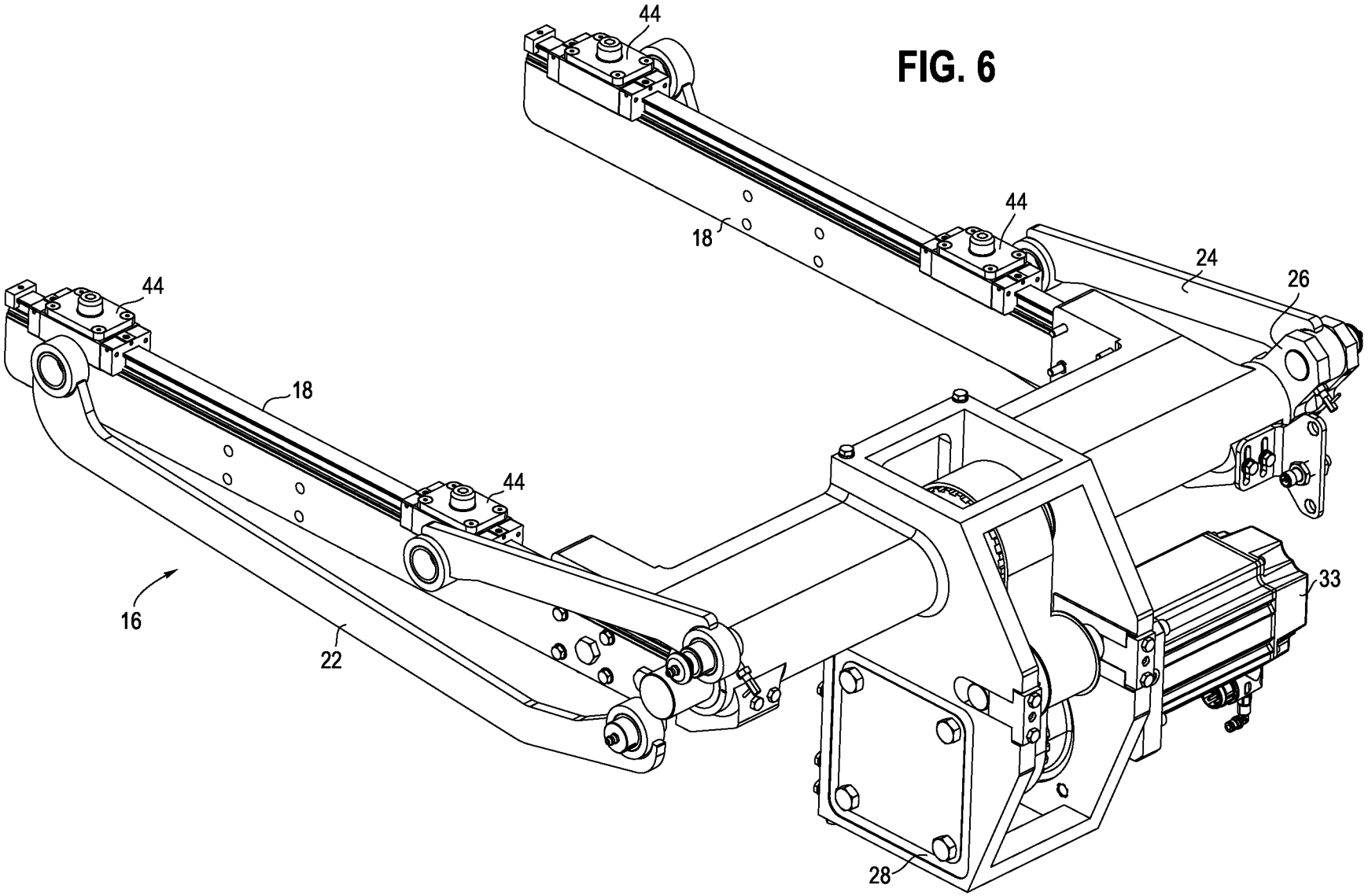
FIG. 6 is a perspective view of the horizontal drive component of the sealing jaw assembly.
Figure 7:
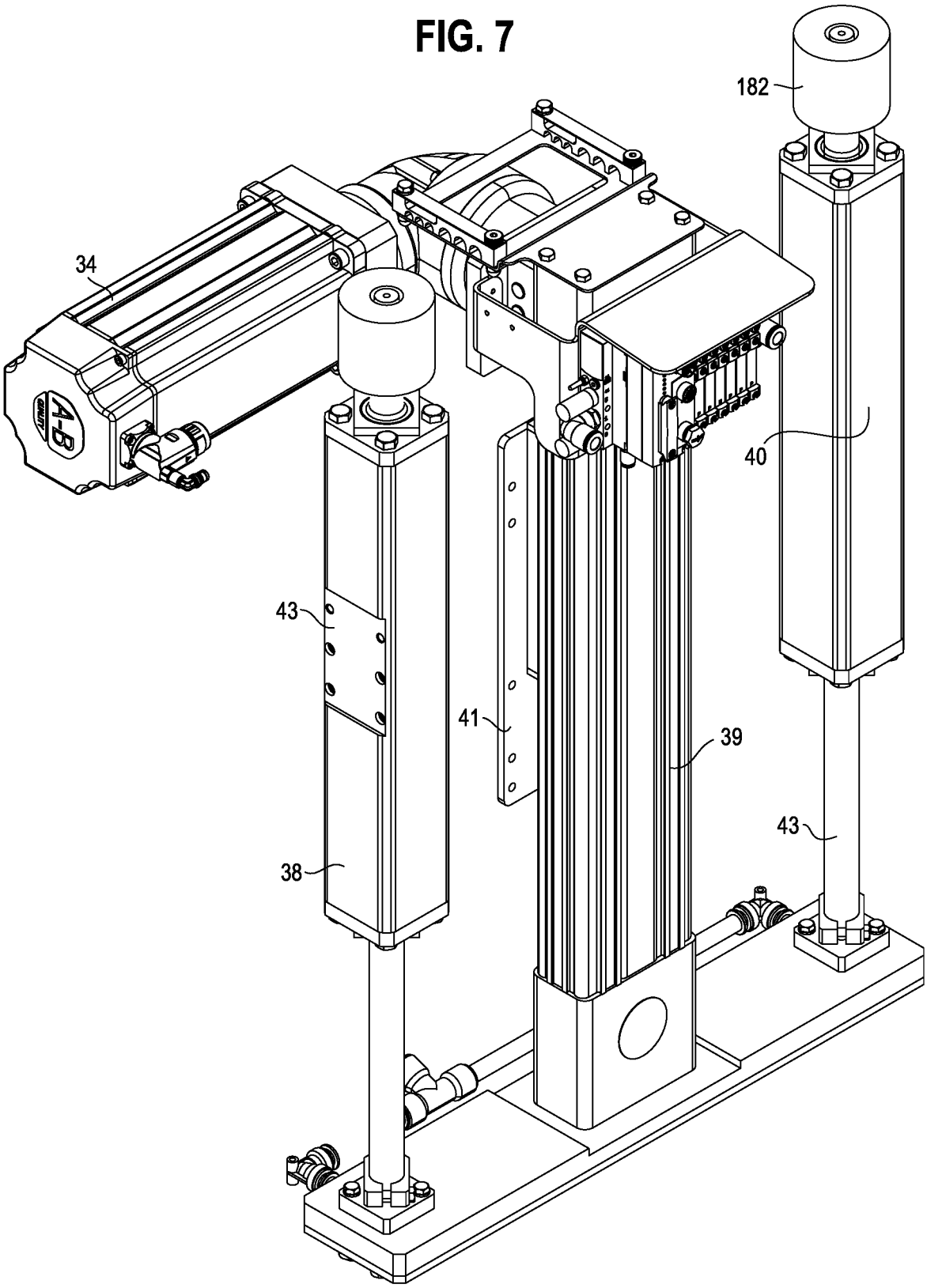
FIG. 7 is a perspective view of the vertical drive component of the sealing jaw assembly.
Figure 20:
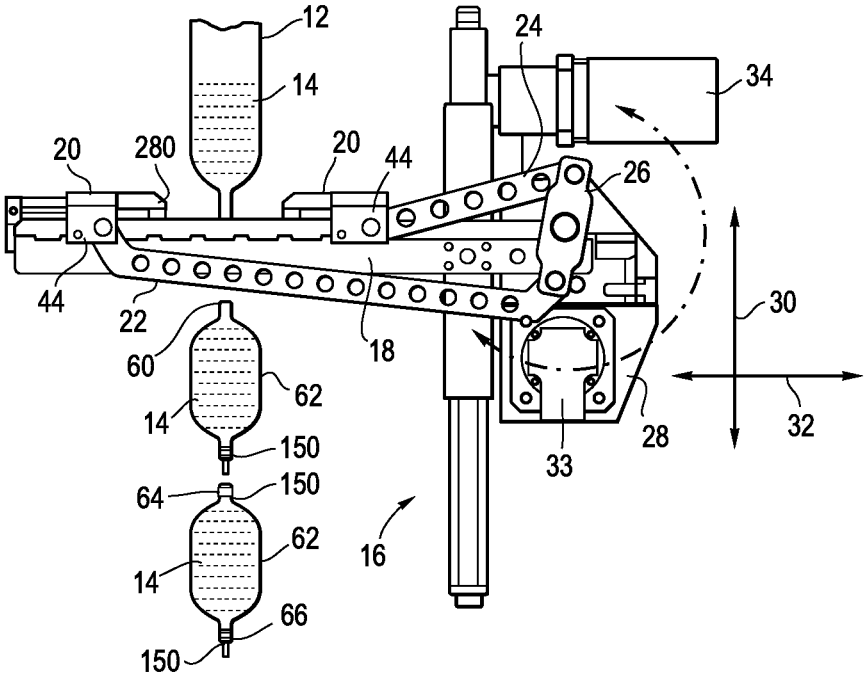
FIG. 20 is a side view of a sealing and cutting assembly.
Figure 22:
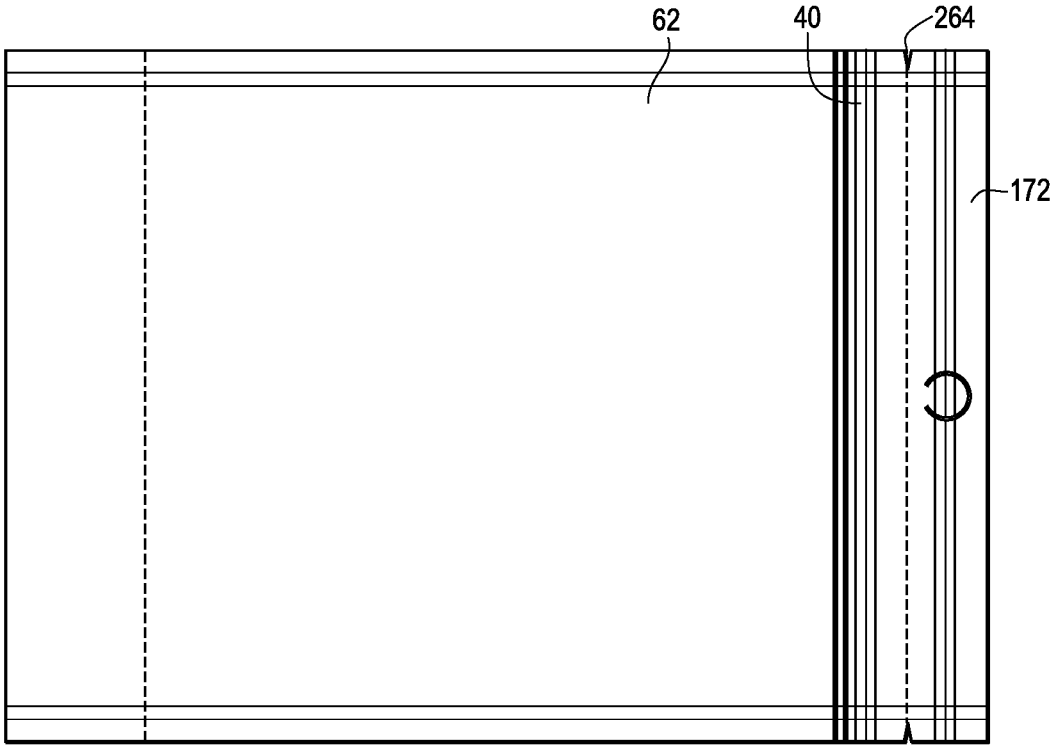
FIG. 22 is plan view of one embodiment of a reclosable bag.
Figure 23:
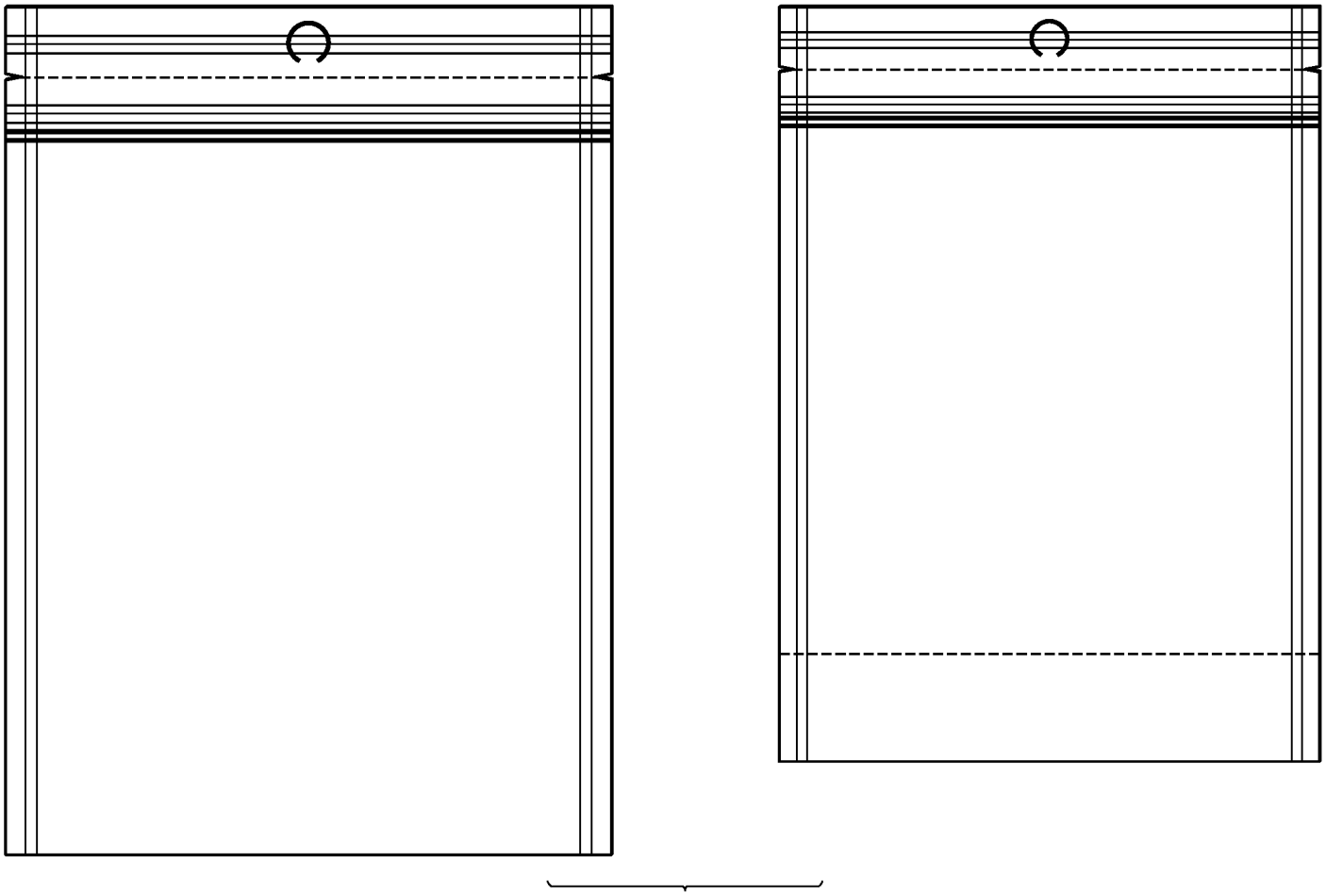
FIG. 23 is plan view of another embodiment of a reclosable bag.
Figure 24:
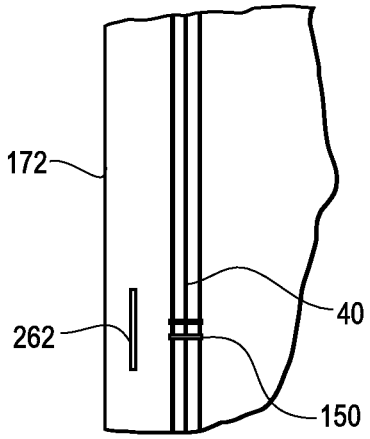
FIG. 24 is a partial front view of the composite film tube with a slit applied thereto by a tear notch applicator.

Form, Fill and Seal Machine:

Referring to FIGS. 5 and 20, a vertical form, fill and seal machine includes a frame 2 and a film cage 6 configured to hold and store rolls 4 of film. The film cage may include dancer rollers that control/maintain the tension of the film as it is introduced to the machine. The dancer rollers speed up or slow down the power unwind of the film from the film roll 4. The film is unrolled from the roll 4 and is guided to a forming shoulder 8, which forms the film into a tubular structure around a forming tube. As is well known in the art, packages of various shapes and sizes can be formed by changing the forming tube and forming shoulder. A vertical seal assembly 10 seals the film to form a film tube 12. Product 14, including for example and without limitation various liquid or solid food products, is loaded through an open end of the forming tube into the film tube 12, which is sealed to form a bag 62 filled with the product 14 (see also FIGS. 22 and 23). In one embodiment as shown in FIG. 23, the bag 62 may be configured with one or more hole punches 480 positioned in the sealed ends of the bag, for example in a portion of the end seals (drag seal), and outwardly from a reclosable fastener material 40.

Reclosable Fastener Material Handling Assembly

Figure 8A:
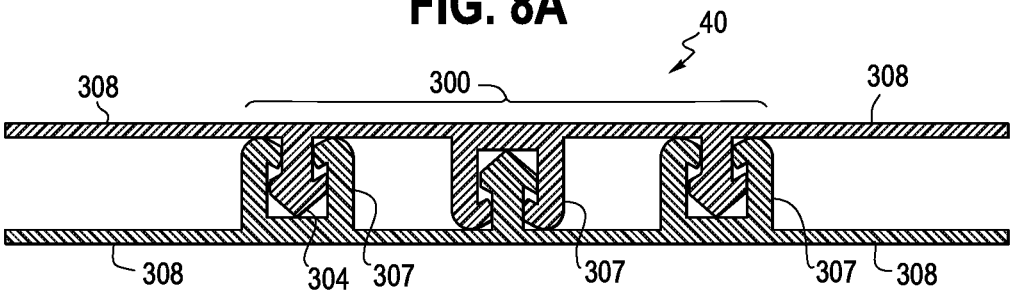
FIGS. 8A and B is a cross-sectional view of one embodiment of a four flange reclosable fastener and a corresponding partial cross section of a rotary anvil with a circumferential sealing surface and relief.
Figure 8B:
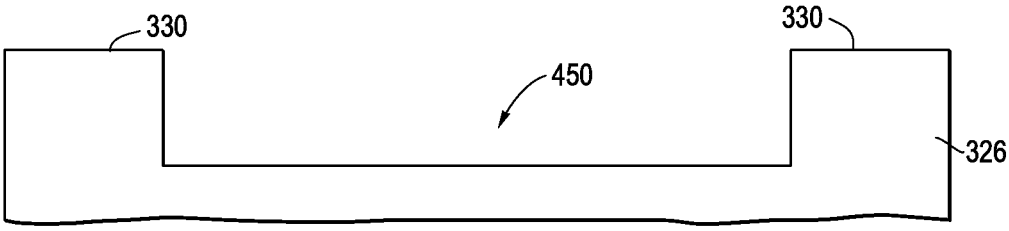
Figure 9:
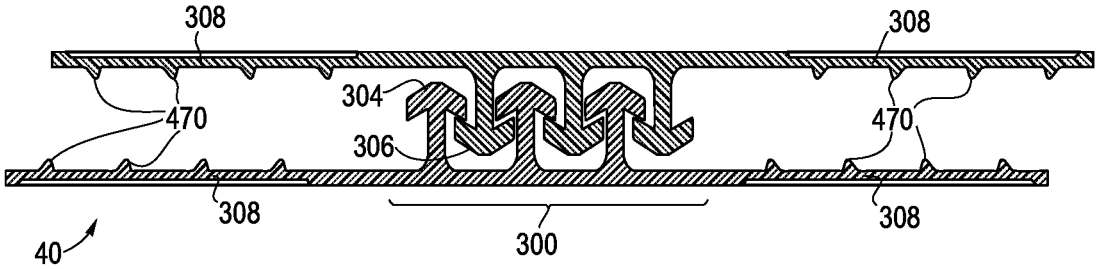
FIG. 9 is a cross-sectional view of one embodiment of a four flange reclosable fastener.
Figure 10:
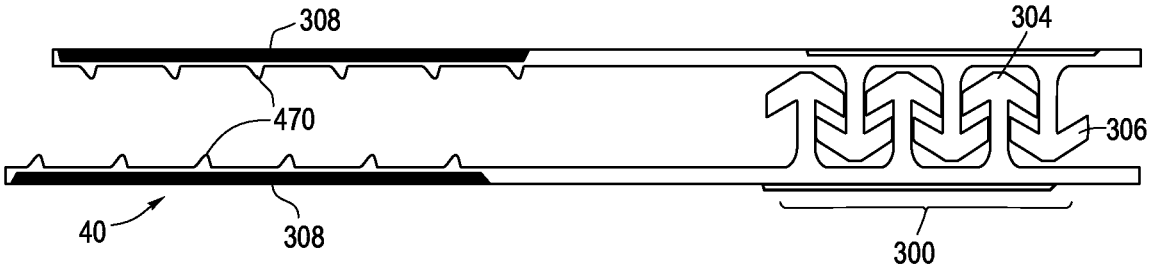
FIG. 10 is a cross-sectional view of one embodiment of a two flange reclosable fastener.
Figure 11:
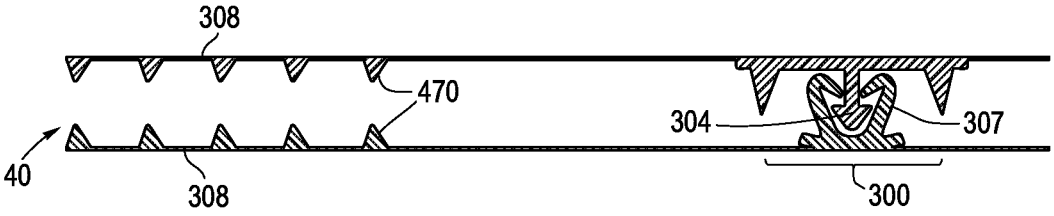
FIG. 11 is a cross-sectional view of one embodiment of a two flange reclosable fastener.

Referring to FIGS. 1 and 9-17, a reclosable fastener handling assembly 100 is shown. The various components of the reclosable fastener handling assembly are coupled to and supported by the frame 2. The reclosable fastener handling assembly 100 feeds the reclosable fastener material 40 at a constant speed and consistent tension with intermittent spaced apart flattened portions, defined as welds or crushed portions, repeating such that the flattened portions 150 match the location of a bag cutoff as described below. In other embodiments, the intermittent spaced apart flattened portions are not formed prior to the vertical seal, but rather the cross-sealing jaw, disclosed herein, forms a flattened portion. The phrase "reclosable fastener material" refers to a strip of such material, which may be stored on a roll 102, and includes without limitation reclosable fastener material strips having mounting flanges 308 (e.g., 2 or 4) and interlocking male and female fastener elements 300, e.g., hook and loop fasteners, interlocking mushroom heads 304, 306 having catch members (FIGS. 9 and 10), heads 304 and channels 307 having inwardly turned lips or catch members (FIGS. 8 and 11), and/or like systems, preferably made of a plastic material, such as polyethylene or other plastics. The reclosable fastener material may be referred to as a zipper fastener. The mounting flanges may be configured with protuberances, or barbs 470, facing inwardly from the flanges. The barbs provide grippable features, allowing a user to grip the flanges, disengage the interlocking fastener elements and open the bag during use. The barbs further assist in preventing opposing mounting flanges from being sealed together when the reclosable fastener is being sealed to the film tube.

Figure 12:
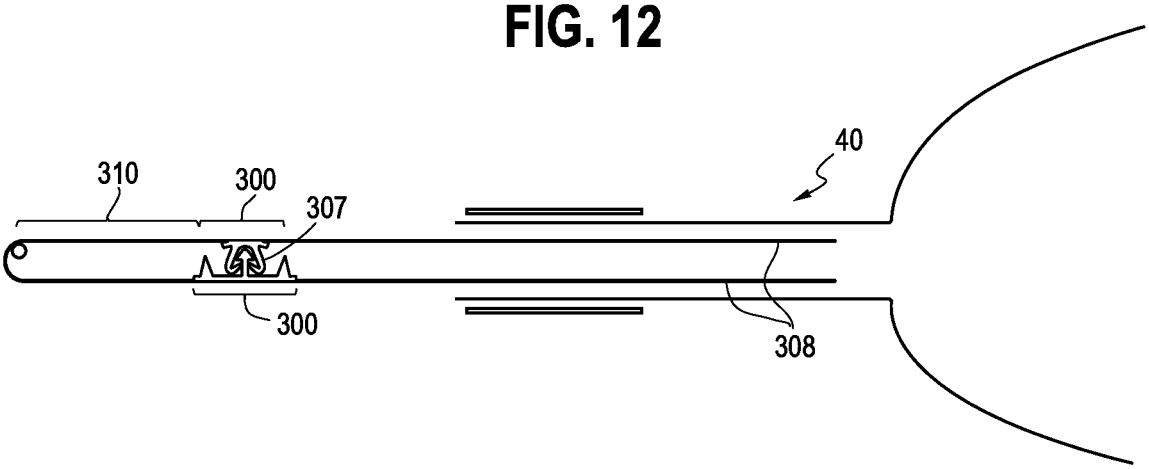
FIG. 12 is a cross-sectional view of one embodiment of a reclosable having a hermetic sealed portion.
Figure 13:
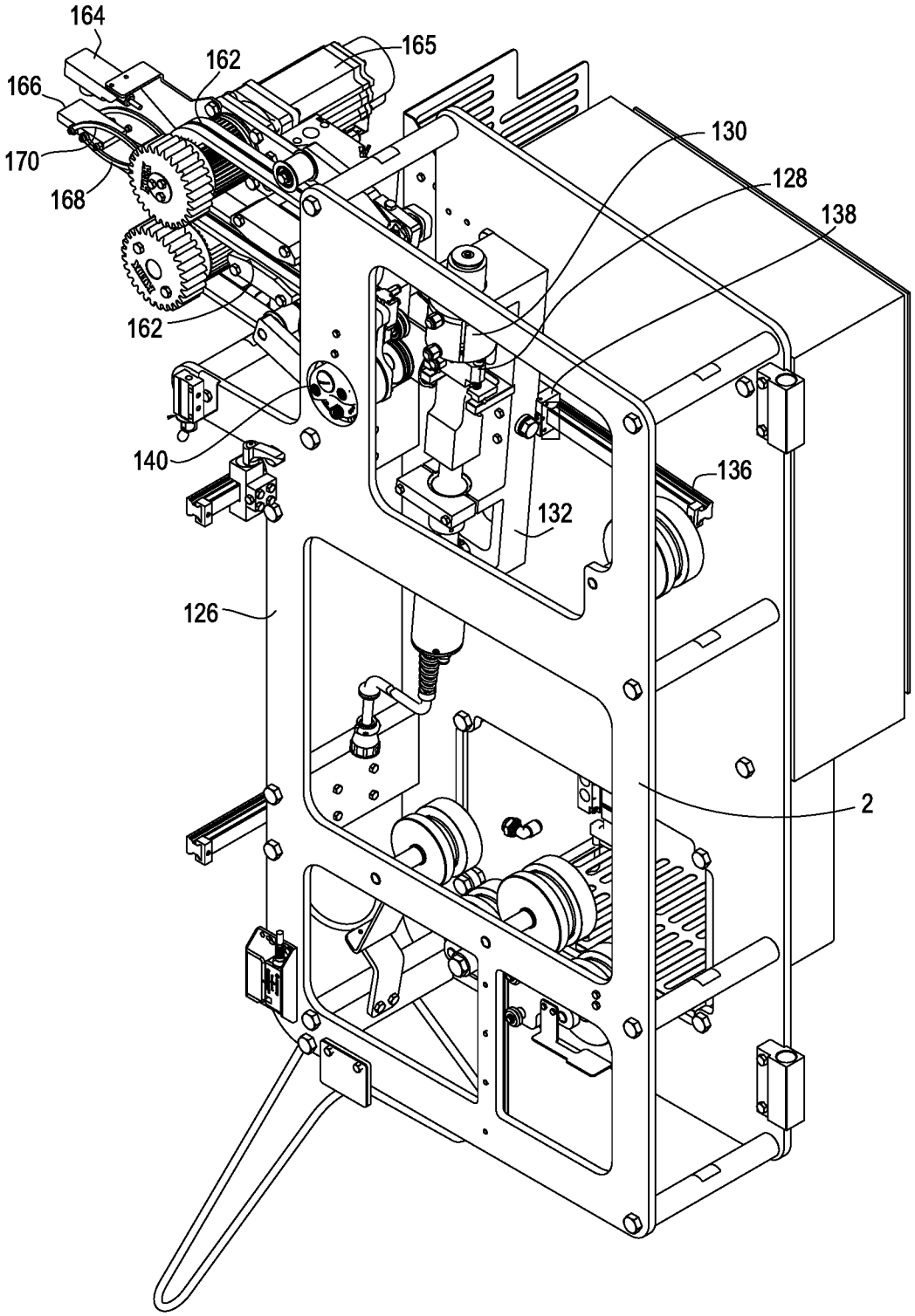
FIG. 13 is a perspective view of the reclosable fastener handling assembly.
Figure 14:
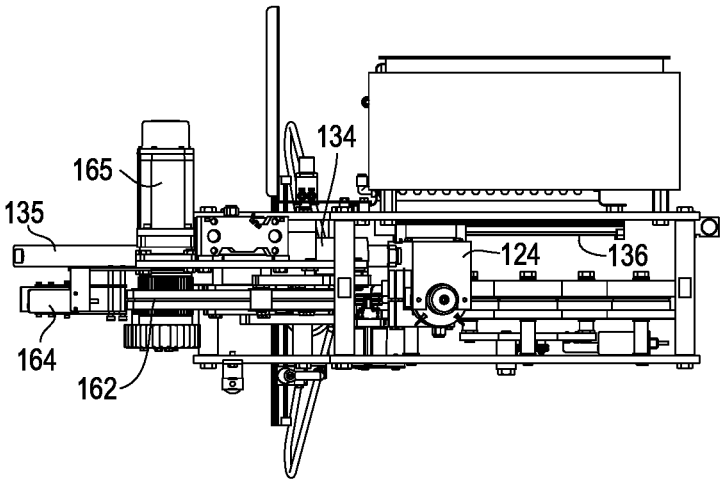
FIG. 14 is a top view of the reclosable fastener handling assembly shown in FIG. 13.
Figure 15:
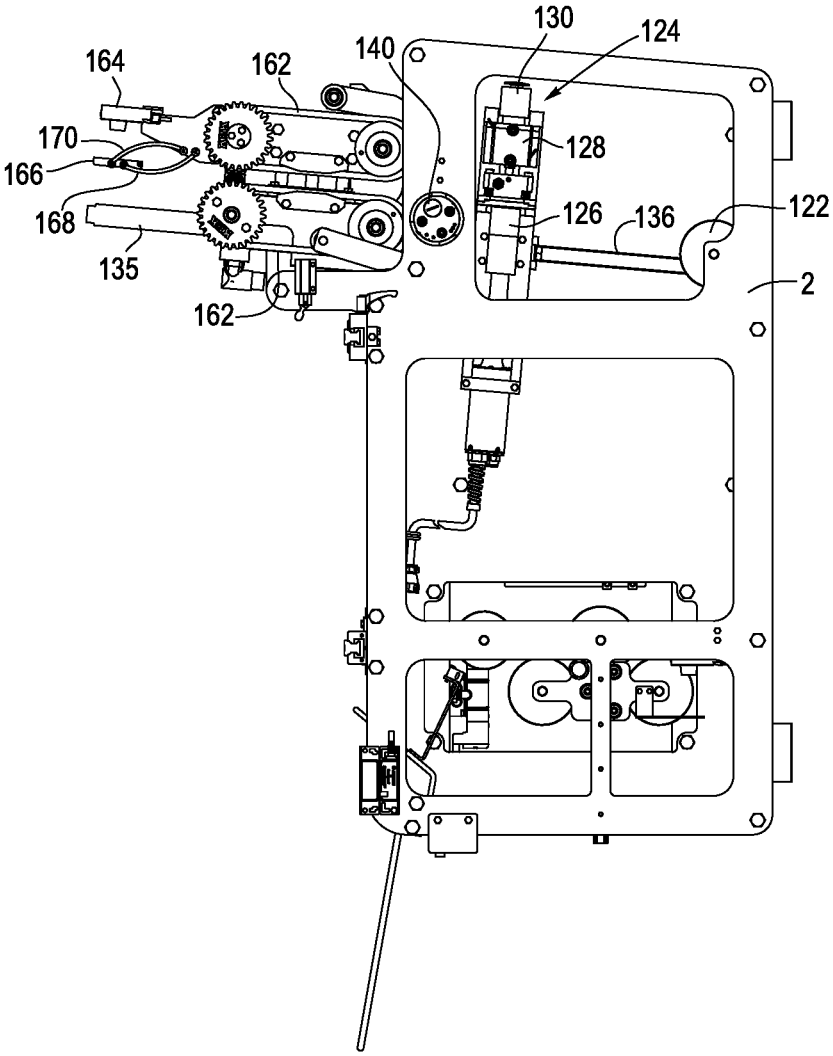
FIG. 15 is a front view of the reclosable fastener handling assembly shown in FIG. 13.
Figure 16:
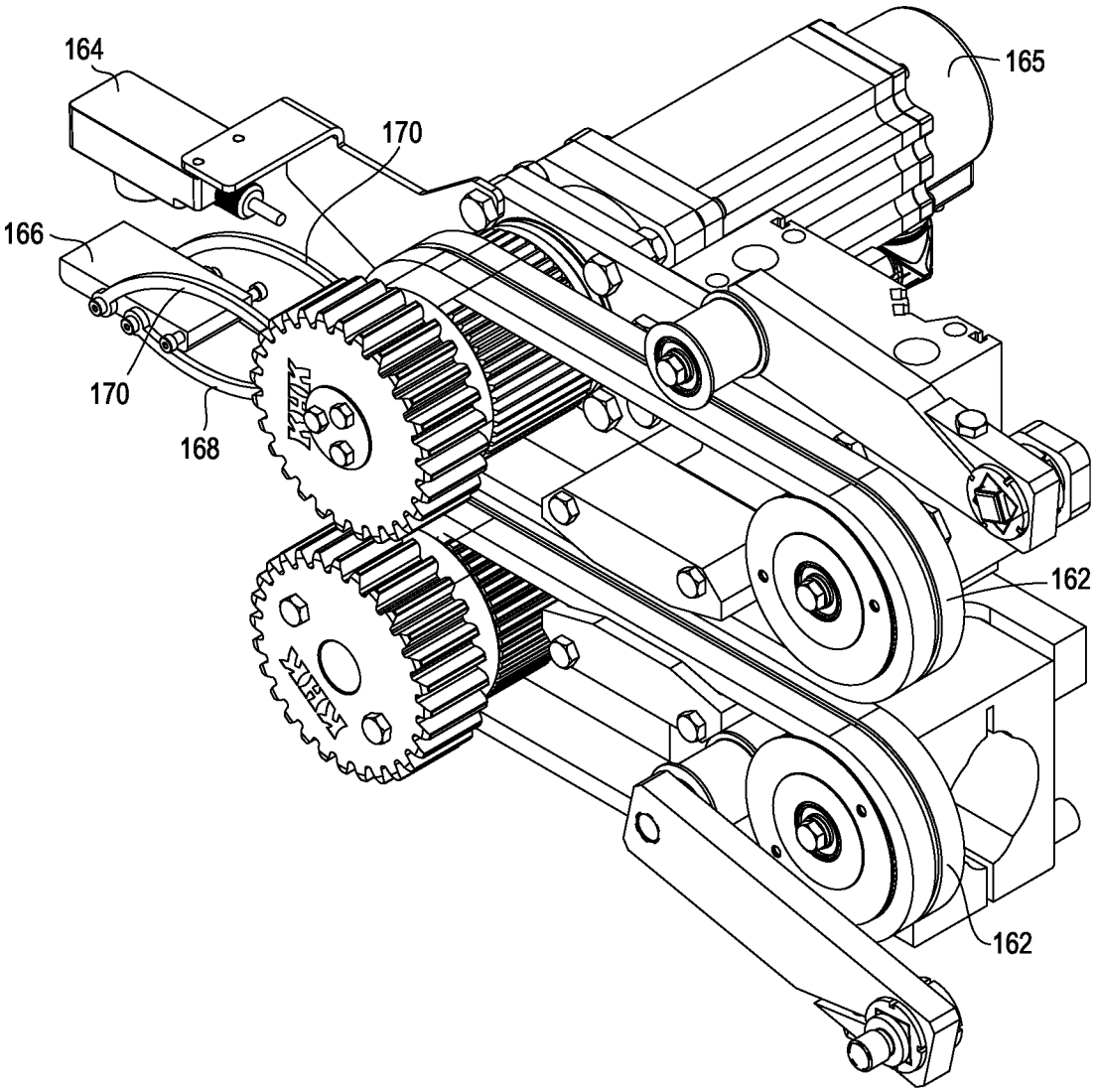
FIG. 16 is a perspective view of the reclosable fastener feed device and slack sensor.
Figure 17:
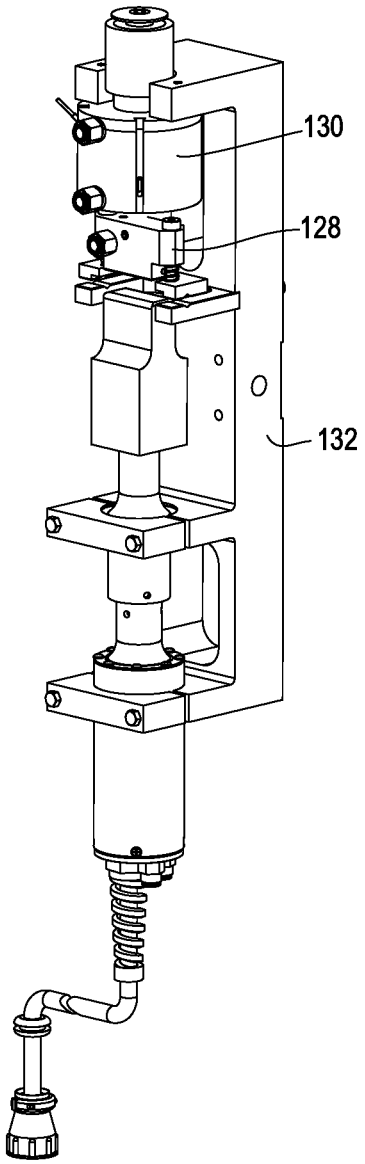
FIG. 17 is a perspective view of one embodiment of a reclosable fastener flattening device.
Figure 18:
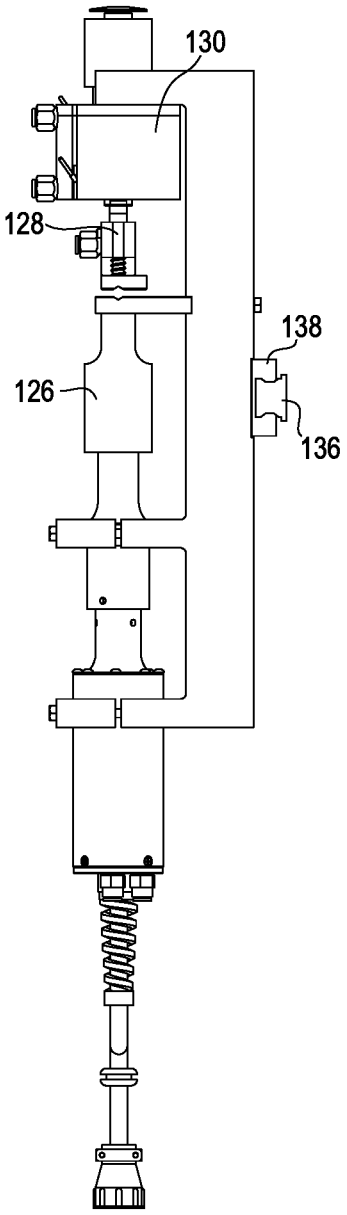
FIG. 18 is a side view of the flattening device shown in FIG. 17.
Figure 19:
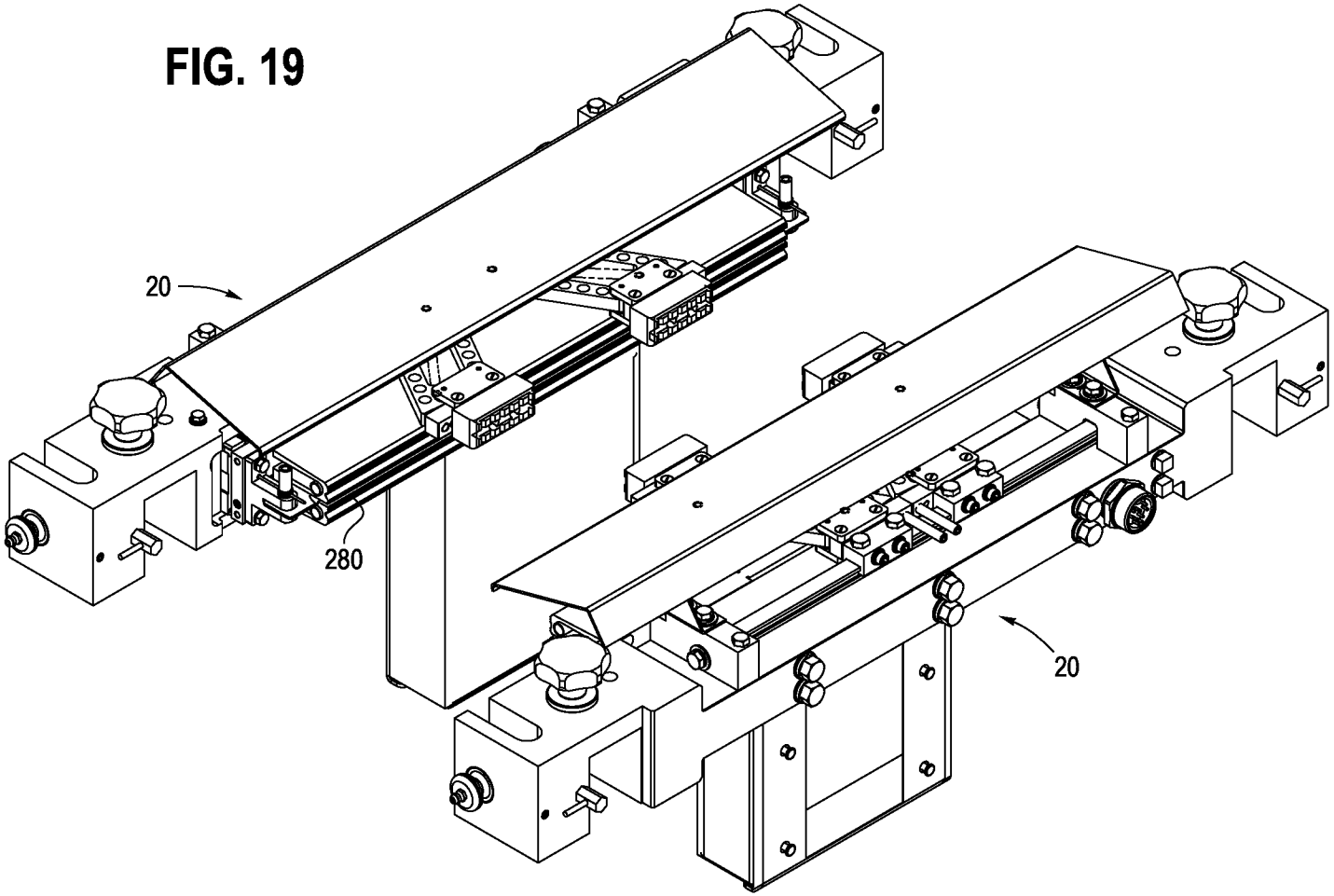
FIG. 19 is a perspective view of a pair of sealing jaws.

In one embodiment, shown in FIG. 12, one embodiment of a two flange reclosable fastener strip has interlocking fastener elements 300, a pair of flanges extending from one side of the fastener elements and a sealed end 310 (hermetic sealed portion) extending from an opposite side of the fastener elements 300. It should be understood the reclosable fastener material 40 may be configured with a plurality of sliders, which may be grasped and manipulated to effect the locking and unlocking of the reclosable fastener material strips.

Figure 1:
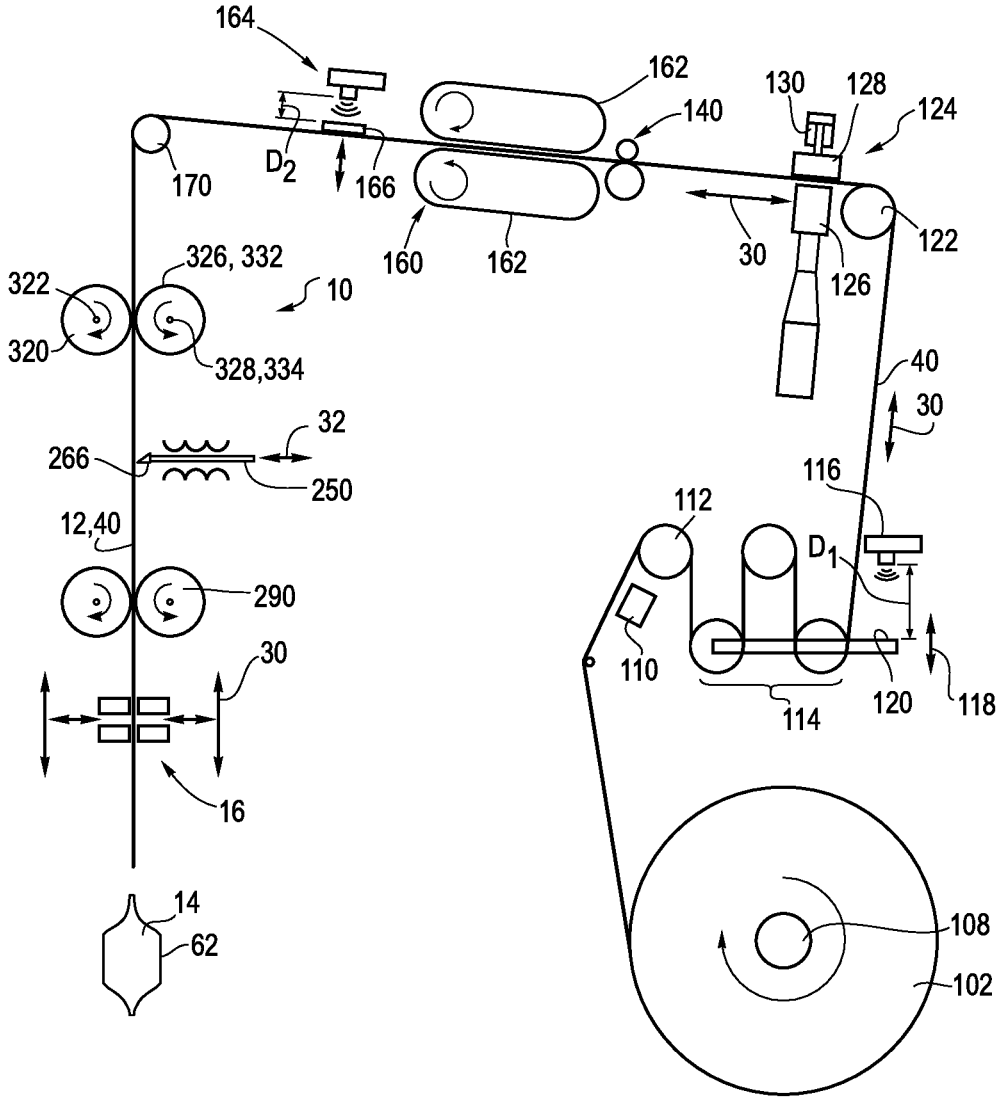
FIG. 1 is a schematic diagram of one embodiment of a vertical form, fill and seal machine showing the progression of reclosable fastener material through the machine.

The roll 102 of reclosable fastener material is mounted on a shaft connected to a variable frequency drive VFD unwind motor 108. The reclosable fastener material moves past a detection sensor 110, which confirms that the reclosable fastener material is present, and passes over a fixed pulley roller 112. The reclosable fastener material then passes through an assembly of dancing rollers 114, which can move up and down on a slide 118. The dancing rollers 114 apply a constant tension to the reclosable fastener material 40 as determined and set by the weight of the assembly. An unwind roller sensor 116 is configured as a distance or proximity sensor that detects the position of the moveable dancing rollers 114, or target portion 120 coupled thereto, as shown in FIG. 1. The distance measurement (D1) is used as feedback for the VFD (FIG. 25), such that the unwind motor 108 varies its speed to achieve a consistent dancing rollers 114 position, and thereby a consistent feed rate and tension. A controller, such as a programmable logic controller (PLC), receives input from the sensors 110, 116 and controls the speed of the VFD motor 108, or servo drive portion thereof. It should be understood that all of the components disclosed herein are coupled to and supported by the frame 2, directly, or through another component.

Referring to FIGS. 1, 13-15 and 25, the reclosable fastener material 40 travels downstream in the machine direction 30 from the dancing rollers 114 to a fixed pulley roller 122, affixed to the frame, adjacent a flattening device 124, configured in one embodiment as an ultrasonic weld system. The ultrasonic weld system includes an ultrasonic stack 126, or horn, positioned on one side of the reclosable fastener material and an anvil 128 mounted to an air cylinder 130 and positioned on an opposite side of the reclosable fastener material. The flattening device is mounted on a bracket 132, which in turn is coupled to a slide 138 that moves along a rail 136 or track supported by the frame 2. A linear servo motor 134 reciprocally moves the flattening device back and forth on the rail 136 along a machine direction 30, or parallel to the path of the reclosable fastener material. A slider 135, or magnet encapsulated in a metal rod, passes through and is reciprocally driven by the motor 134, with the flattening device being moved therewith.

Figure 21:
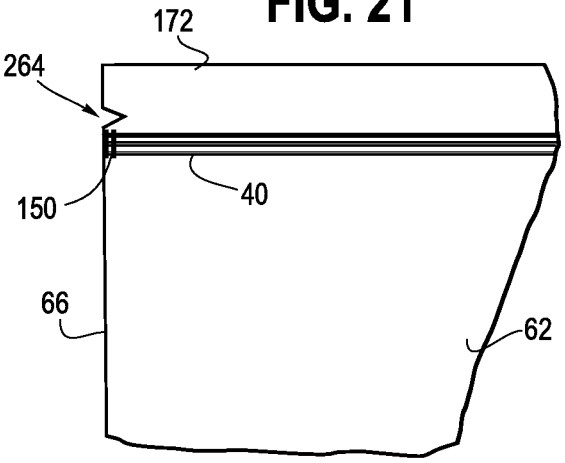
FIG. 21 is a partial front view of a reclosable bag having a tear notch.

An encoder 140 positioned downstream of the flattening device 124 monitors the speed and position of the reclosable fastener material 40. Using feedback from the encoder 140, a controller, e.g. a programmable logic controller (PLC), matches the speed of the flattening device 124 with the speed of the reclosable fastener material, with the flattening device 124 clamping to the moving reclosable fastener material by actuating the cylinder 130, flattening (e.g., welds or crushes) the reclosable fastener material, un-clamping from the moving reclosable fastener material, and returning in an upstream direction for the next cycle. This motion profile is similar to the motion profile used by the jaw assembly to seal and cut each bag as the film moves continuously down the forming tube as disclosed below. After the reclosable fastener material is flattened or crushed at spaced apart locations, the control system identifies and controls the locations of the flattened portions 150 so that the flattened portions eventually align with the bag cutoff downstream in the machine and process as shown in FIG. 21.

After passing by or through the encoder 140, the reclosable fastener material travels by or through a reclosable fastener feed device 160, which is configured to move the reclosable fastener material in the machine direction 30. In one embodiment, the reclosable fastener feed device includes a pair of spaced apart pinch belts 162 (continuous loops) driven by a servo motor 165, with the belts 162 engaging opposite sides of the reclosable fastener material 40, maintaining positive control of the reclosable fastener material, and propelling the reclosable fastener material 40 forward in the machine direction 30. In other embodiments, the reclosable fastener material feed device may include spaced apart rollers, spaced apart vacuum belts, or combinations thereof.

Downstream of the feed device, a feedback sensor 164 measures a characteristic of the reclosable fastener material, including for example and without limitation the slack, position, force and/or tension of the reclosable fastener material. In one embodiment, the feedback sensor 164 is configured as a slack sensor that measures the slack of the reclosable fastener material. In other embodiments, the feedback sensor may be configured as, or may include, the encoder 140, or may be configured as a tension sensor or other sensor, or combinations of the aforementioned sensors. In one embodiment, the reclosable fastener material 40 travels below and is engaged by a dancer plate 166 coupled to and supported by two pairs of links 168, 170. The dancer plate 166 moves up or down in response to the tension (or slack) of the reclosable fastener material 40, with the sensor 164 measuring the distance (D2) between the sensor 164 and the dancer plate 166, which defines a target portion for the sensor 164. The position of the target portion, or plate 166, provides an input to the slack sensor 164, which in turn provides an output communicated to the reclosable fastener feed device 160, or controller (PLC) associated therewith, as a sensor input. In response, the controller and the servo motor driving the reclosable fastener feed device 160 makes small corrections to maintain a consistent slack in the reclosable fastener material. For example, the reclosable fastener feed device adjusts the speed of the movement, or length/feed amount, of the reclosable fastener material in response to the input from the feedback sensor. This has the effect of maintaining the reclosable fastener material 40 at a consistent tension as it passes through the remaining downstream systems.

Vertical Seal Assembly

Referring to FIGS. 1-7 and 27A-E, the reclosable fastener material 40 travels in the machine direction 30 over a forming set pulley 170, whereinafter the reclosable fastener material is introduced to and joined with the film tube 12 at a vertical seal assembly 10. At the vertical seal location, the reclosable fastener material 40 and film 4 are traveling at the same speed. The vertical seal assembly 10 attaches the reclosable fastener material 40, and in particular the mounting flanges 308, to the film tube 12 between opposite and facing overlapping edges 174 thereof while also forming a separate vertical edge seal 172 between the overlapping edges 174 of the film tube 12.

Figure 27A:
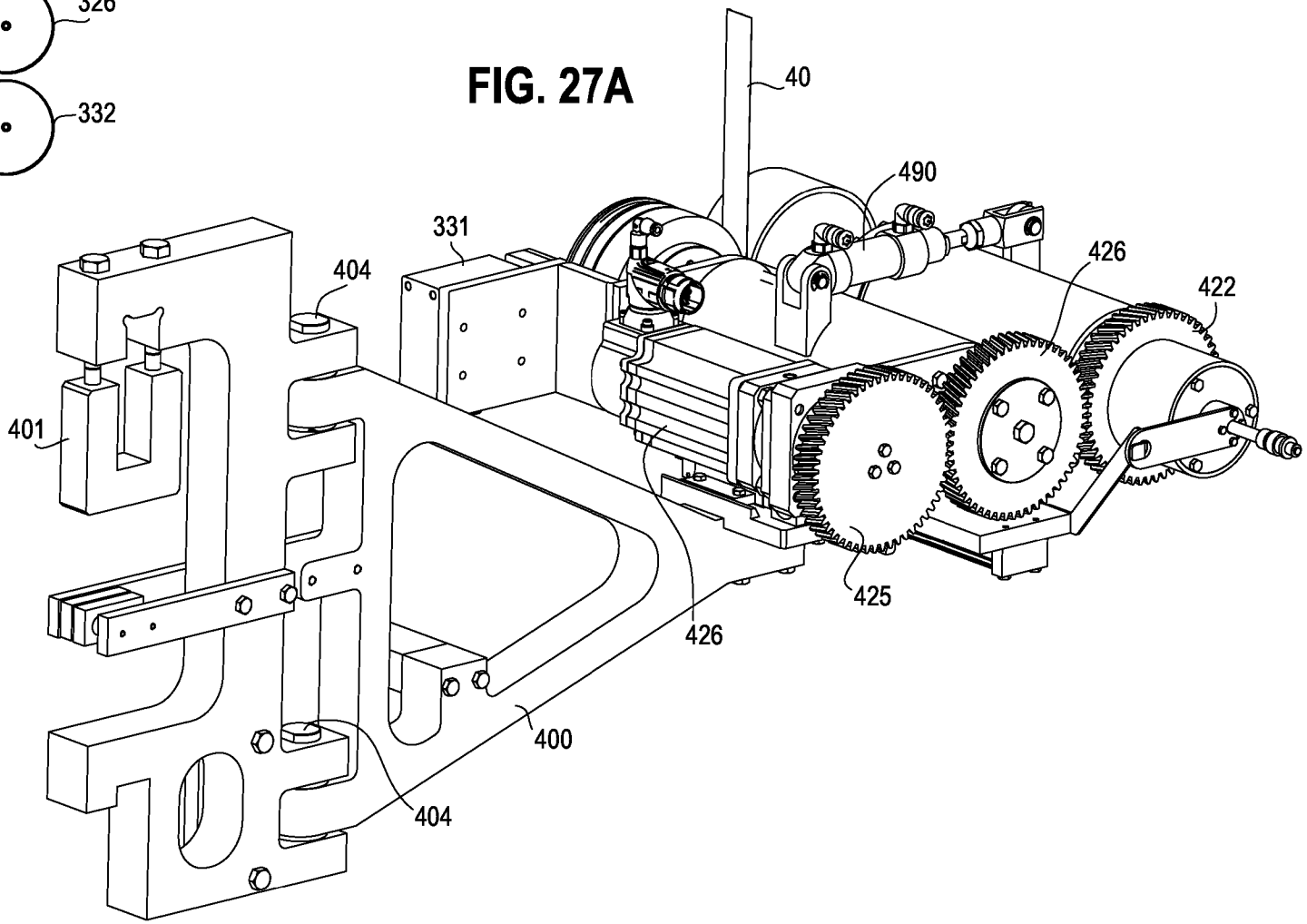
FIGS. 27A-E are perspective, top, rear, side and cross-sectional views of one embodiment of a dual rotary ultrasonic sealing assembly.

The sealing of the reclosable fastener material 40 to the film tube 12 and of the film tube edge seal 172 are done continuously, with the film 4 passing through a dual rotary ultrasonic seal assembly 10. It should be understood that the term "dual" rotary ultrasonic seal assembly refers to an assembly having a rotary horn and at least one rotary anvil, although a "dual" assembly may include more than one rotary anvil. The assembly includes a frame 400 that is pivotable secured to a bracket 402 about a pivot pin 404. An opposite side of the frame 400 is coupled to a second bracket with a latch, or release mechanism 410. The brackets 402, 408 are attached to the frame 2. As shown in FIG. 27A, the frame 400 may be clamped to the main frame of the vertical form, fill and seal machine, for example with a U-shaped clamp 401. The frame 400 may be pivoted about one or more pivot pins 404 so that an operator may access the ultrasonic components housed therein for maintenance or change-over/removal/reinstallation of one or more anvils or horn.

The ultrasonic seal assembly includes a rotary ultrasonic horn 320, or sonotrode, which is rotatable about a first horizontal axis 322. The horn has an outer circumferential/peripheral surface 324. The horn may have a substantially circular, generally disk-shape, with the peripheral surface being substantially continuous.

A first rotary ultrasonic anvil 326 is rotatable about a second horizontal axis 328 spaced apart from the first axis 322. The first rotary anvil 326, referred to as a zipper anvil, has an outer circumferential surface 330, which is disposed adjacent to the circumferential surface 324 and forms a first nip therebetween. The surface 330 may be spaced apart from the first surface 324 and form a gap G1 therebetween at the nip. G1 and G2 are equal to the total thickness of the material being sealed or attached at each respective location. The force of contact is controlled by the actuators, rather than controlling the gap in one embodiment. The first anvil may have a substantially circular, generally disk-shape, with the peripheral surface being substantially continuous. Alternatively, the first anvil may have a non-circular shape, or may have a discontinuous outer peripheral surface. The first anvil may be configured with one or more spokes or lobe members, which may have the same or different sizes and/or shapes.

Figure 27B:
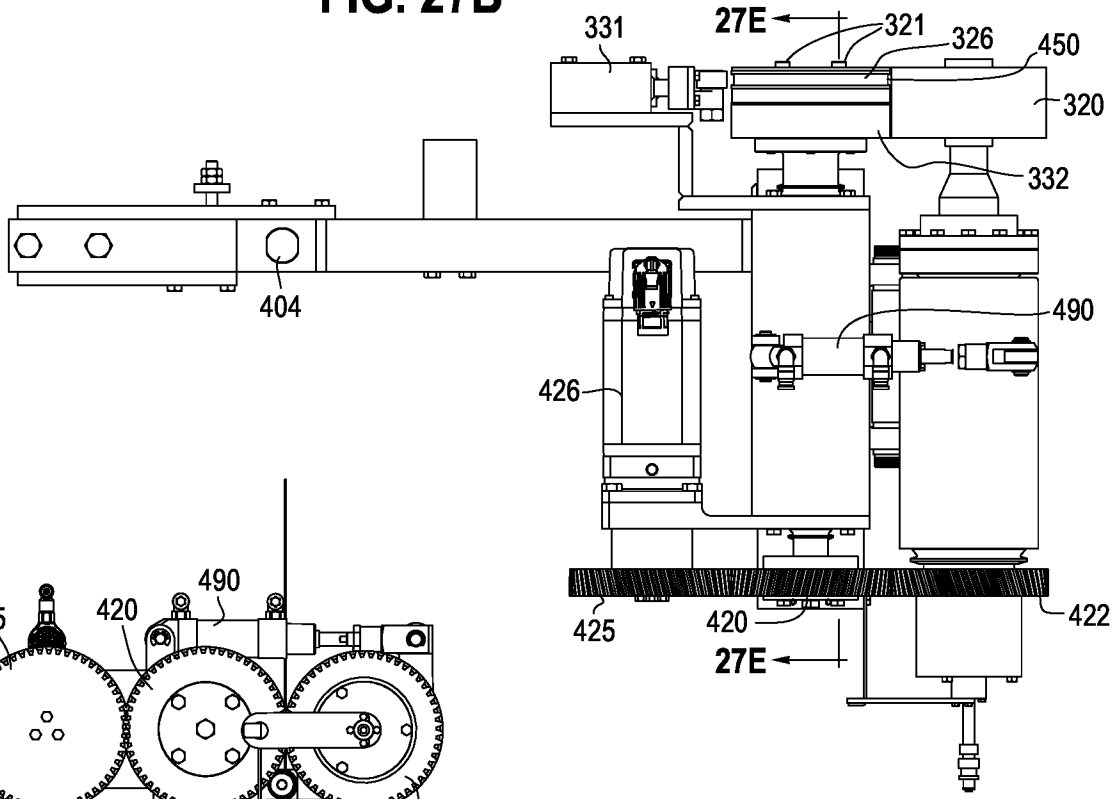
Figure 27C:
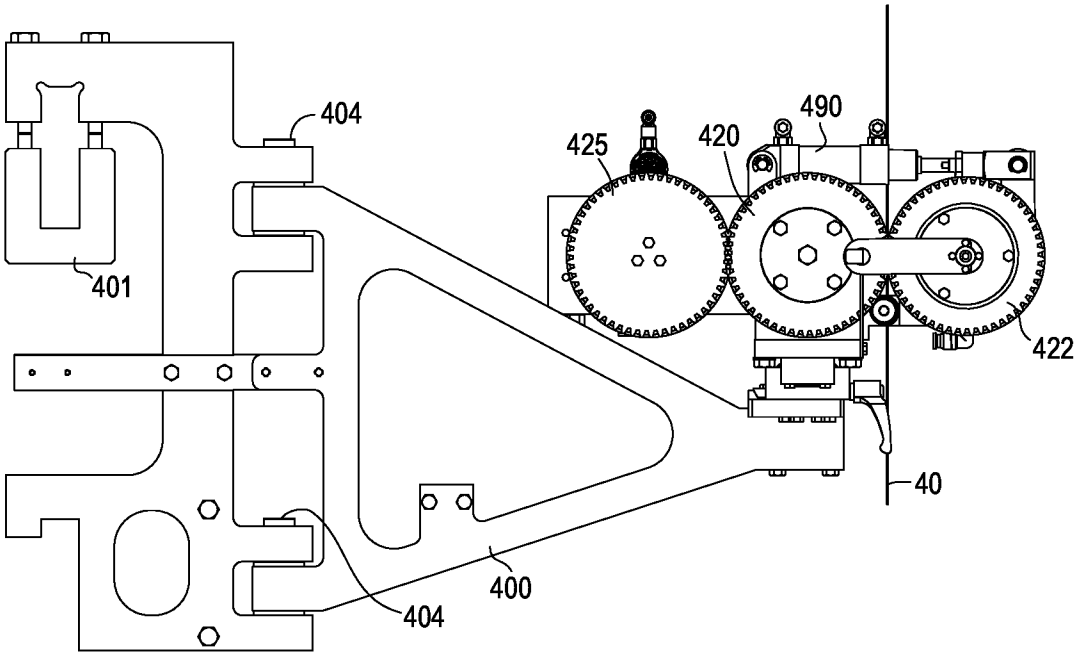
Figure 27E:
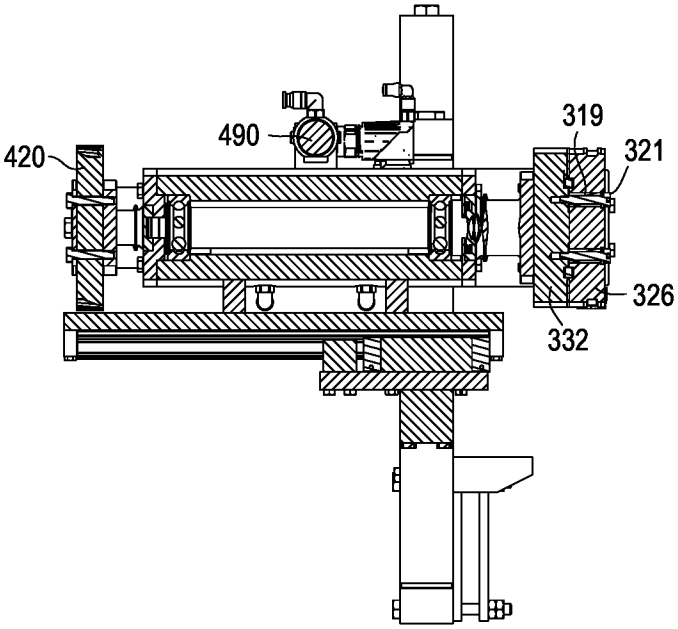
Figure 27D:
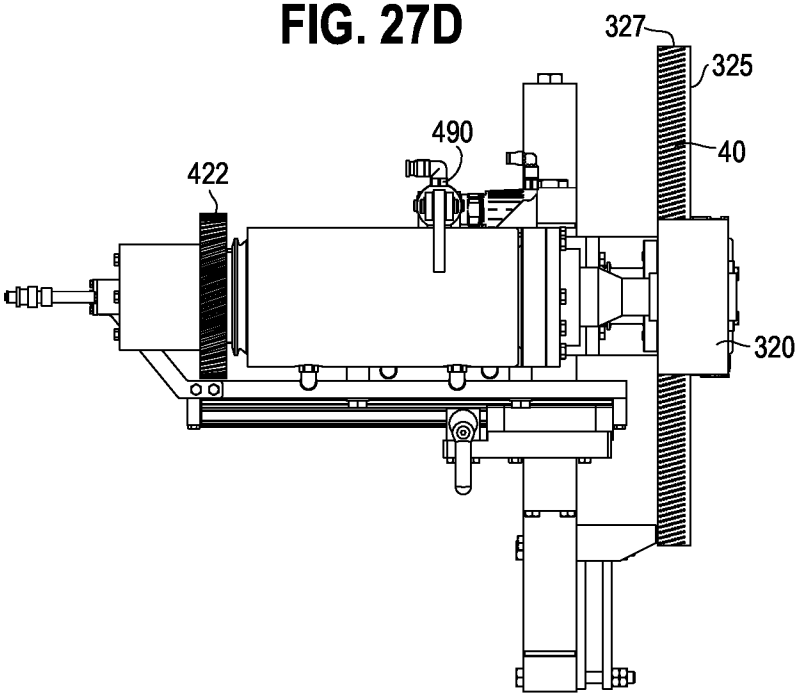

A second rotary ultrasonic anvil 332 is rotatable about a third horizontal axis 334 spaced apart from the first axis 322. The third axis 334 may be coaxial with and defined by the second axis 328. The second rotary anvil, referred to as a vertical seal anvil, has an outer circumferential surface 336, which is disposed adjacent the circumferential surface 324 and forms a second nip therebetween. The surface 336 may be spaced apart from the first surface 324 and form a gap G2 therebetween at the second nip. The second anvil may have a substantially circular, generally disk-shape, with the peripheral surface being substantially continuous. Alternatively, the second anvil may have a non-circular shape, or may have a discontinuous outer peripheral surface. The second anvil may be configured with one or more spokes or lobe members, which may have the same or different sizes and/or shapes. It should be understood that the vertical seal anvil, or the shape of the second rotary anvil 332, may be configured such that there is a hermetic seal 325 and an adjacent cosmetic/structural seal 327 as shown in FIG. 27D.

Figure 3:
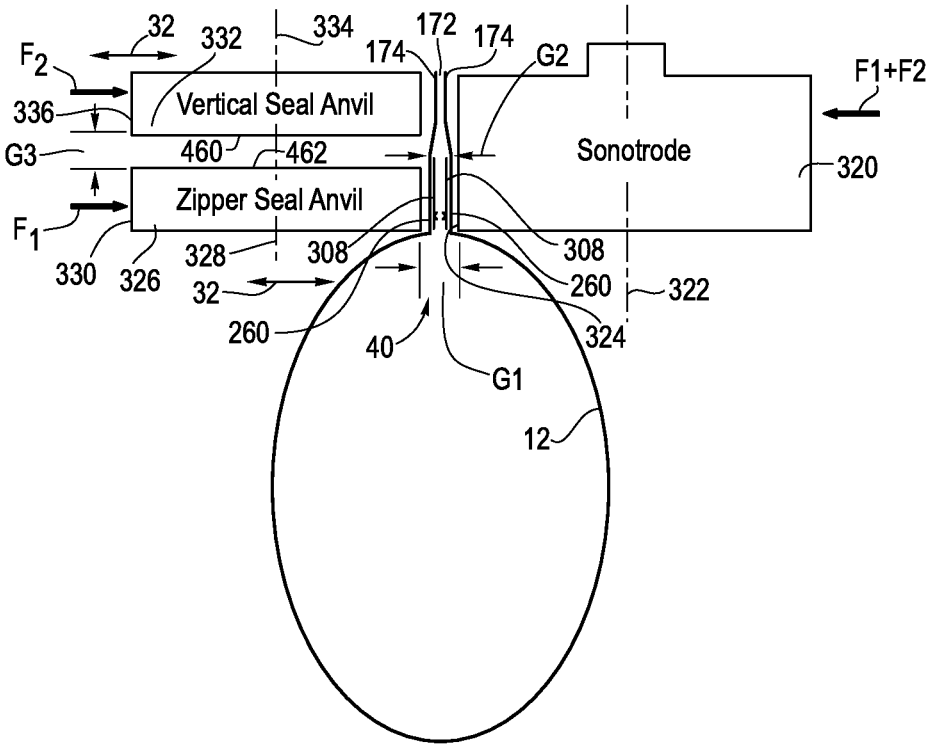
FIG. 3 is a cross-sectional view showing the passage of a film tube and reclosable fastener material through a dual rotary ultrasonic sealing assembly.

In various embodiments, the gaps G1 and G2 may be the same or different, for example with the gap G1 being greater than the gap G2 to accommodate the reclosable fastener as shown in FIG. 3. As further explained below, the gaps may change as different forces are applied to the first and second rotary ultrasonic anvils 326, 332, or to both the anvils and the horn. Or the gaps may be controlled by altering the forces or moving the actuators applying the forces. In other words, the forces and/or gaps between the horn and anvils may be controlled at the nips. It should be understood that the gaps and forces may not be correlated, for example where a greater force is applied at a respective nip, but without a decrease in the gap.

It should be understood that the anvils may be rotatable about different axes that are spaced apart and parallel, or may be coaxial. For example, one of the anvils may "float" in one embodiment, allowing lateral movement when an applied force is determined. In this embodiment, the forces (F1, F2) applied to the rotary ultrasonic anvils 326, 332 are an "input," with corresponding forces being applied to the film tube and reclosable fastener at the nips. The gaps at the respective nips may or may not vary in response to the relative forces applied to the anvils. For example, one of the anvils 332 may be shifted laterally with an actuator 492 as further explained below. Moreover, the diameters of the anvils 326, 332 may be the same or different. For example, the anvils may have the same diameter, but with the axes spaced apart such that G1 is greater than G2. In summary, the system may include an input of forces (F1, F2), which may be the same or different, with F1>F2, or vice versa, F2>F1, or an input of gaps (G1, G2), which may be the same or different, with the understanding that forces and gaps are not necessarily correlated.

There are a variety of embodiments allowing the rotary ultrasonic anvils 326, 332 to rotate about different axes. For example, as shown in FIGS. 2A-E, the first rotary ultrasonic anvil 326 is driven or rotated by gear 420, which is synchronized with the ultrasonic horn 320 through gear 422. The second rotary ultrasonic anvils 332 has a large hole or bore passing through it, thereby providing an opening for a shaft 430 connected to the rotary ultrasonic anvil 326 to pass through the opening. The second rotary ultrasonic anvil 332 moves side to side on a separate rail mount 321 in response to a force applied thereto so to come in contact with the sonotrode or horn 320, or with the film tube disposed in the nip therebetween. In this way, the second rotary ultrasonic anvil 332 is free to move laterally relative to the first ultrasonic rotary anvil 326, with the two axes being parallel and substantially coaxial, or slightly spaced apart, for example 0-2 mm. In this embodiment, the second ultrasonic anvil is not driven, but rather rotates in response to the friction applied by the film tube and horn as the second ultrasonic anvil is pressed against the horn, with the film disposed therebetween.

Other systems may be designed with both anvils being driven. For instance, the two anvils may be connected loosely with an elastomeric coupling as shown in FIG. 27E, such that one anvil drives the other. For example, four shoulder bolts 321 may be used to attach the first rotary ultrasonic anvil 326 to the second ultrasonic anvil 332. The bolts 321 extend through elastomeric sleeves 319, which transmit rotation and permit displacement for independent force control. In this way, the rotation of the anvil 326 is coupled to (driven by) the rotation of the anvil 332, but the gap/force between the anvil 326 and horn 320 is adjustable because the elastomeric coupling allows lateral relative movement between the anvils. The anvils may have friction drives, e.g., force control cylinder 331, on the side opposite the horn which also provide the pressure(s) to the anvils, as shown in FIG. 27B. The force control cylinder 331 applies a lateral force to one of the anvil(s) (e.g. anvil 326 as shown in FIG. 27B).

As shown in FIGS. 2A-E, 8B and 27B, the first anvil 326 may have a peripheral, or circumferential, groove/relief 450 (or stepped portion), which is aligned with the interlocking fastener elements 300, such that a force, or pressure, applied by the anvil is not applied or transmitted to the interlocking fastener elements, thereby inadvertently sealing the interlocking fastener elements 300. Such an anvil 326, with a circumferential sealing surface 330 on both sides of the groove/relief, may be used to seal a four-flange reclosable fastener as the surface 330 is aligned with the opposite pairs of mounting flanges 308. The groove/relief may be omitted from the circumferential surface of the anvil when the anvil is being used to seal a two-flange reclosable fastener. In other embodiments, an anvil configured with a groove/relief may be used with a two-flange reclosable fastener.

In yet another embodiment, a single anvil, having a stepped circumferential surface, with one circumferential surface 330 defined at a first diameter and a second circumferential surface 336 defined at a second diameter, with the first diameter being less than the second diameter, may be used to make the vertical seal (second surface 336) and the reclosable fastener seal (first surface 330). The first surface 330 may have a groove/relief 450 to accommodate the interlocking fastener elements.

Figure 2A:
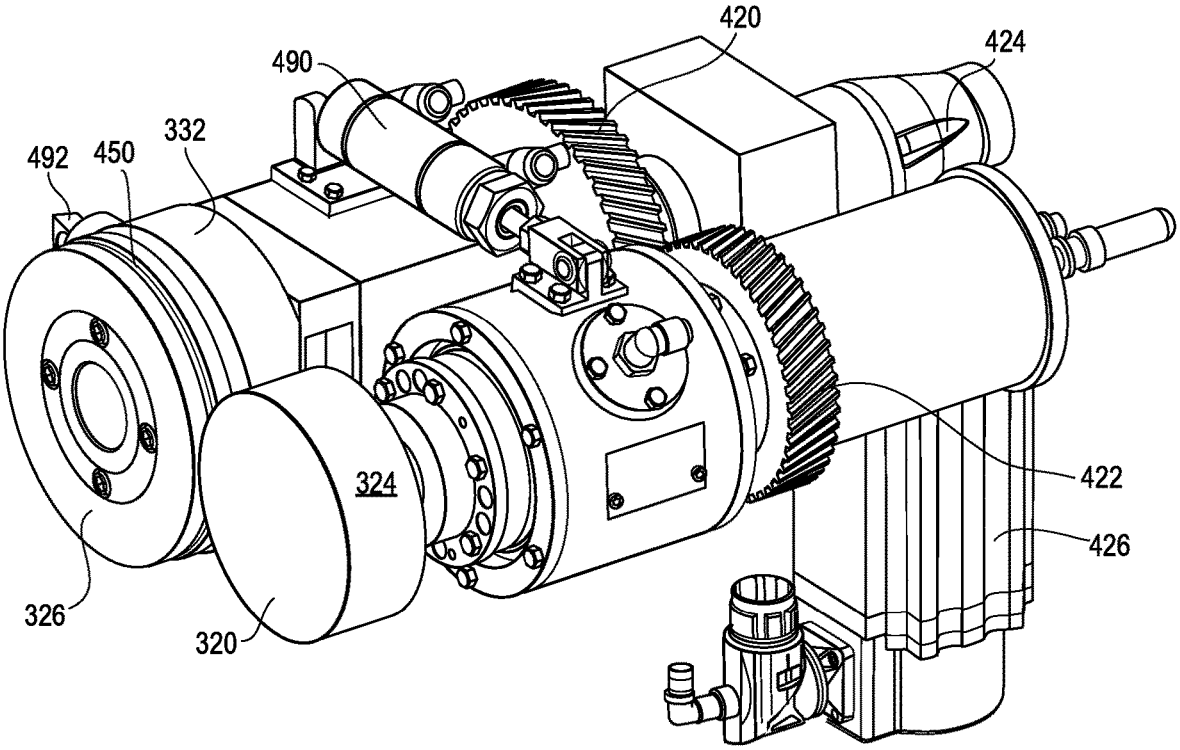
FIGS. 2A-E are perspective, top, front and cross-sectional views of one embodiment of a dual rotary ultrasonic sealing assembly.
Figure 2B:
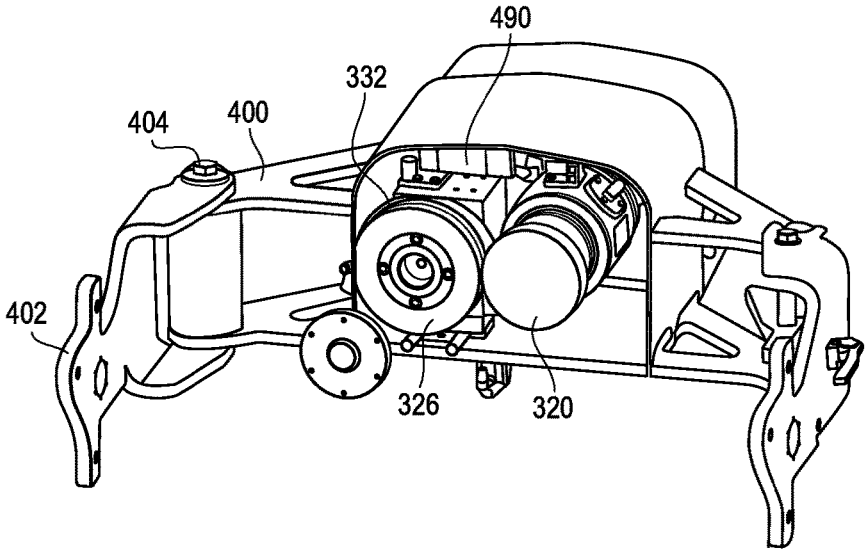
Figure 2C:
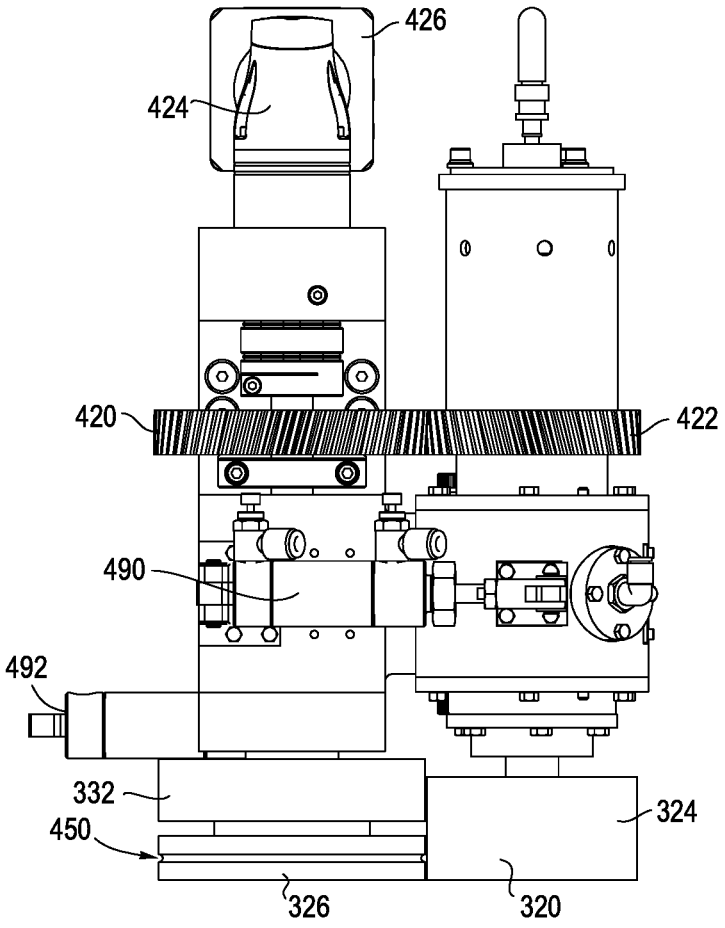
Figure 2D:
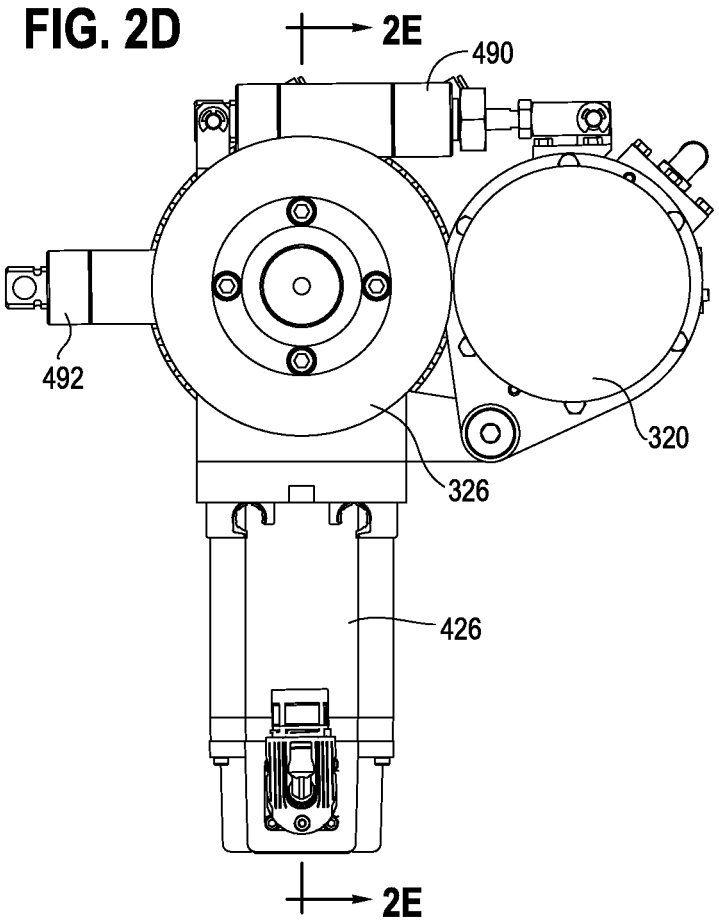
Figure 2E:
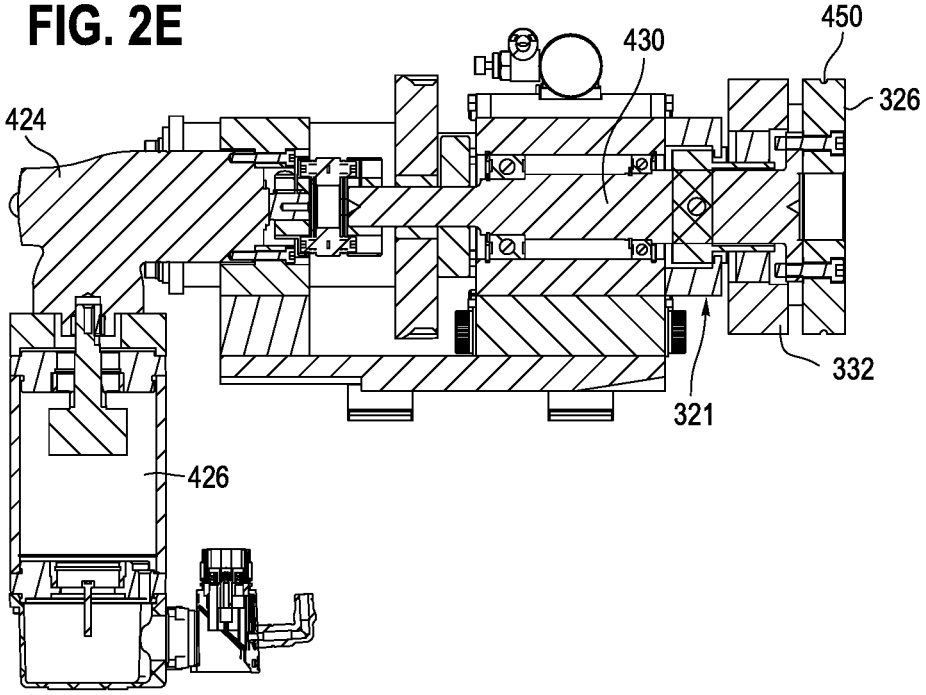

Referring to FIGS. 2A-C, the ultrasonic seal assembly includes a servo motor 426 that drives (rotates) the rotary anvil 326 and rotary horn (sonotrode). A pair of mating/meshing gears, rotatable about the axes 322, 328, includes a drive gear 420 coupled to the shaft 430 driving the first rotary ultrasonic anvil 326, or both anvils, and a driven gear 422 coupled to the shaft 432 driving the rotary horn/sonotrode. A gear box 424 is coupled between the servo motor and drive shaft 430 for the anvil. Alternatively, as shown in FIGS. 27A-C, the servo motor 426 is positioned on the side of the rotatory anvils 332, 326, with a drive gear 425 engaging (meshing with) intermediate drive gear 420, which meshes with and drives the driven gear 422. A first actuator 490 extends between and is coupled to the horn and anvil assemblies. The actuator 490, for example a pneumatic or hydraulic cylinder, or a linear servo actuator, moves the horn 320 and anvil 326 assemblies toward or away from each other so as to apply a greater or lesser force or pressure to the edges of the film tube and mounting flanges of the reclosable fastener disposed therebetween. A second actuator 492 provides or applies a force or pressure to the second (vertical seal) anvil 332. As noted earlier, the shaft 430 passes freely through the anvil 332, which is mounted on a sliding block 321 that allows the anvil 332 to move independently towards and away from the sonotrode or horn 320. In other embodiments, the anvil 332 is stationary, with the anvil 326 being moved in response to a force, or both anvils may be moveable.

Figure 26:
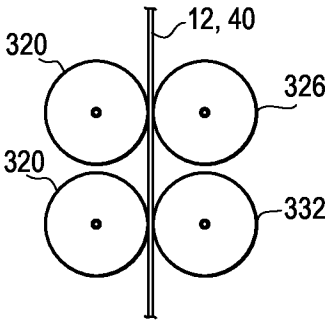
FIG. 26 is a schematic of another embodiment of a vertical seal assembly.

In yet another embodiment, shown in FIG. 26, a system includes two sonotrodes/horns 320 and two anvils 326, 332, where the first sonotrode/anvil combination 320, 326 creates the recloseable fastener seal, and the second sonotrode/anvil combination 320, 332 creates the vertical seal. Conversely, the first sonotrode/anvil combination creates the vertical seal and the second sonotrode/anvil combination creates the recloseable fastener seal. It should be understood that the dual sonotrode/dual anvil system may be used with the various other features and components for vertical form, fill and seal machines as disclosed herein.

In one embodiment, the actuator 492 acts only on the anvil 332, applying force $F_{492}$. In contrast, the force applied to the anvil 326 is equal to the force of the actuator 490 minus the force of the actuator 492 ($F_{326}=F_{490}-F_{492}$), while the force applied to the anvil 332 is $F_{492}$. As mentioned, the second (vertical seal) anvil 332 is loosely coupled to the drive shaft, for example with an elastomeric or magnetic coupling, such that it may be shifted to alter the gap G2 and/or force F2 in response to the force/pressure applied by the actuator 492. Alternatively, as disclosed herein, the anvil 326 is loosely coupled to the anvil 332.

Figure 4:
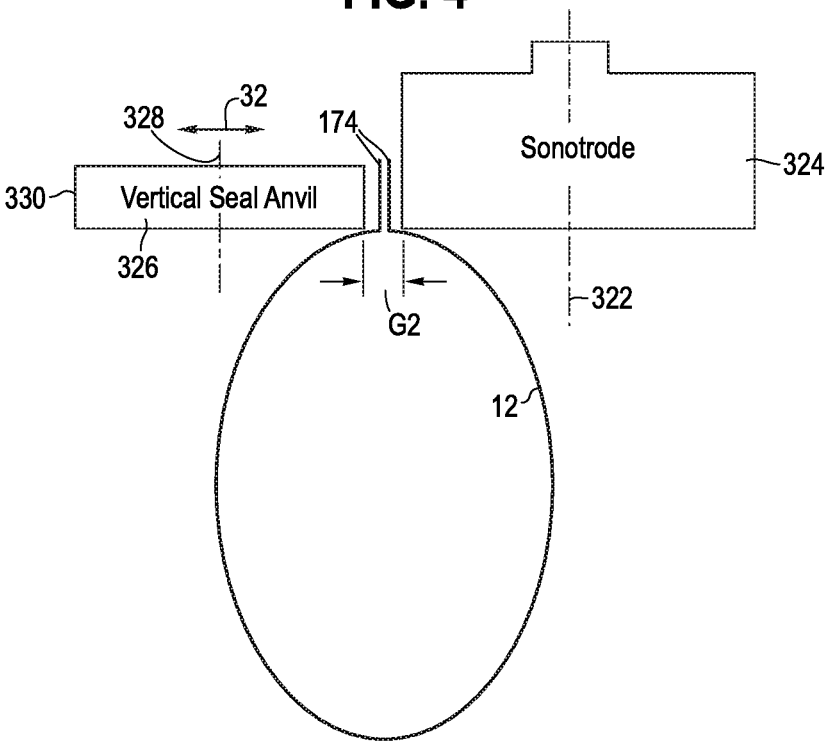
FIG. 4 is a cross-sectional view showing the passage of a film tube through a rotary ultrasonic sealing assembly.

As shown in FIG. 4, the second anvil may be removed from the sealing assembly when a reclosable fastener material is not being applied, or where only one seal is being used with a reclosable fastener as shown in FIG. 12. In these embodiments, the first rotary anvil 326, or zipper anvil, may be used as the vertical seal anvil. In addition to the removability of one or both of the anvils, the anvils 326, 332 are adjustable in a transverse direction 32 to allow for different forming operations including accommodating various embodiments of reclosable fasteners or assemblies made without reclosable fasteners, such as a plain vertical seal on a pillow bag assembly. For example, actuators 490, 492, 331 may be coupled respectively to the horn and/or anvils such that the first and second gaps (G1, G2) may be increased or decreased. The actuators 490, 492, 331 are independently actuatable, such that first and second forces (F1, F2) may be independently adjusted, for example as applied to the first and second anvils or to the film tube and reclosable fastener at the nips, which may also result in the anvils being independently moveable, and/or the first and second gaps (G1, G2) may be independently adjusted. The horn and anvils may be quickly removed and/or replaced for example by various mechanical fasteners.

The sealing assembly 10, including the horn 320 and anvils 326, 332, is positionally fixed in the machine direction. The phrase "positionally fixed" means the component is not moveable in the indicated direction (e.g., machine, vertical, lateral, transverse, etc.) during the normal operation of the machine, but may or may not be adjusted in such a direction when the machine is not operating. The horn 320 and second anvil 332 are configured to seal the outer portions of the overlapping edges 174 of the film tube and form the edge seal 172, while the horn 320 and first anvil 326 are configured to seal the reclosable fastener material 40, and in particular the mounting flanges 308, to inner portions of the edges 174 and film tube 12 as shown in FIG. 3.

Advantageously, the dual rotary ultrasonic sealing assembly does not require that a guide blade be positioned between the horn and anvil and between the two mounting flanges 308 of the reclosable fastener material so as to prevent those flanges from being sealed to each other. Rather, an outer surface of one of the mounting flanges 308 is sealed to an inner surface of one of the film tube edges 174 to form a seal 260, and an outer surface of the other mounting flange is sealed to an inner surface of the other edge 174 of the film tube to form another seal 260. The energy and pressure applied by the ultrasonic sealer is controlled such that the interlocking portions 304, 306 of the reclosable fastener material are not heat sealed one to the other.

In one embodiment, shown in FIG. 3, the horn has a width that overlaps with the combined widths of the first and second anvils. In various embodiments, the first anvil has a width that may accommodate various reclosable fastener materials as shown in FIGS. 8-12, including two and four flange reclosable fastener materials. For example, the width of the anvils may include and/or be between 5 and 25 mm with appropriate reliefs 450 provided as needed, and the horn may have a width of, or between, 10 and 60 mm.

Tear Notch Applicator

After the film tube 12, with the reclosable fastener material 40 attached thereto so as to define a composite film tube, exits the vertical seal assembly 10, the composite film tube passes a tear notch applicator 250. The tear notch applicator is optional, meaning it does not have to be deployed when manufacturing certain kinds of bags. The tear notch applicator 250 includes a knife 266 that makes a small slit 262 in the composite film tube in the longitudinal machine direction. The slits 262 is positioned between the reclosable fastener material seal 260 and the edge seal 172. The knife 266 is mounted on a slide assembly 268 that moves in the transverse lateral direction 32. The tear notch applicator 250 is positionally fixed in the machine direction, meaning the tear notch applicator is not moveable in the machine/longitudinal direction during the normal operation of the machine, but may or may not be adjusted in such a direction when the machine is not operating. A controller times the actuation of the knife 266 such that the slit 262 is made in the composite film tube at a location where the slit 262 is intersected by a knife 280 making a transverse cut to separate the bags, with a portion of the slit 262 defining a tear notch 264 at each end of the bag as shown in FIG. 21. The tear notch(s) 264 allow a consumer to more easily tear open a bag 62. It should be understood that the slitting device may include other types of cutting devices besides a knife, including without limitation air and water jets, hot wire, die, shear, ultrasonic devices, and/or combinations thereof.

The tear notch applicator includes a linear servo motor, which momentarily positions the knife 266 in the film path at a time coordinated with the sealing jaw motion, such that the tear notch 264 is located at the bag cutoff line. In one embodiment, the knife 266 moves in and out in about 66 milliseconds, which is the total time from when the knife starts moving toward the film until it returns to the starting position. The knife is in the film path for about 20 milliseconds in one embodiment, wherein a 0.25 inch slide is made with the film moving at 12 inches per second. Depending on the film speed and desired length of the tear notch, the knife may be in the film path for 10 to 100 milliseconds.

Below the tear notch applicator, a driven pulley system, or vertical seal pull assembly 290, pinches the film tube and reclosable fastener material, pulling the film tube and reclosable fastener material in the machine direction, e.g., downwardly in the vertical machine. The pulling action provides tension within the vertical seal assembly 10, which helps the reclosable fastener material attach consistently to the film tube. Without tension, the reclosable fastener material, or film edges, may drag against the vertical seal bars or guide blade, causing the film or reclosable fastener material to bunch up and perhaps require a machine reset. Alternatively, the sonotrode and anvils may maintain sufficient tension such that the driven pulley system may be omitted.

Sealing Jaw Assembly:

Downstream of the ultrasonic sealing assembly, the attached reclosable fastener material and film tube travel together as a composite film tube. The composite film tube travels through a sealing jaw assembly between a pair of sealing jaws, which match speed with the composite film tube traveling downstream in the machine direction, clamp the composite film tube to form a transverse seal across the composite film tube as the sealing jaws travel with the composite film tube, cut the film tube and reclosable fastener material at a specified repeat location, open and release the composite film tube, and return in the upstream direction for the next cycle.

Referring to FIGS. 6, 7, 19 and 20, one embodiment of a sealing jaw assembly 16 is shown. In this embodiment, which is for a "continuous" motion machine, the assembly 16 includes a drive system having a pair of rails 18 that carry a pair of jaws 20, which are moveably supported on the rails with guides 44. The jaws 20 are moved together and apart on the rails by a pair of arms 22, 24, which are driven in turn by a pivot lever 26. A servo motor 33 rotates the pivot lever 26 in opposite first and second rotational directions so as to move the jaws 20 toward and away from each other as the jaws are supported by the rails. The rails 18 and jaws 20 are carried by, and move vertically with, a carriage assembly 28 in the longitudinal machine direction 30. The carriage is mounted on a pair of linear guides, shown as air cylinders 38 in this embodiment, which slide along a guide rod 43. A central column, or linear actuator 39, includes a servo belt drive, configured with a servo motor 34 and belt with air assist. The linear actuator 39 moves the carriage assembly 28 up and down in the longitudinal machine direction 30 on the air cylinders 38. The carriage is secured to a plate 41 on the linear actuator and to the sides 43 of the air cylinders. The air cylinders 38 provide a damping system for the carriage system of air pressure, while also providing an upward thrust force (e.g., about 200 lbf), or support system, to counteract the dead weight of the jaw assembly. The air pressure is automatically controlled by a regulator so that the peak servo motor torque is minimized. As such, the carriage assembly 28 can move with the air cylinders at high speeds and accelerations with reduced wear and tear on the system. In addition, the jaws 20 can be moved toward and away from each other in a lateral direction 32 independently of the vertical movement of the carriage assembly 28 by actuation of the motor 33 that is coupled to the pivot lever. The movement of the carriage assembly and the actuation of the jaws are programmable, and can be configured or operated by a controller, such as a computer or PLC, having a user interface. In one embodiment, the system is controlled by Rockwell Automation's ControlLogix, with a touchscreen human-machine interface.

The jaws 20 are configured with a sealing device and a film separation device. The sealing device is mounted to one of the jaws between upper and lower grippers. The sealing device, in one embodiment, has a length equal to or greater than the width of the composite film tube 12. The sealing device may be configured as a heat seal bar, an ultrasonic sealing device or other suitable sealing device. In one embodiment, the sealing device is configured as an insert, which is secured to the carriage with a quick-release mechanism, including for example and without limitation removable pins. The film separation device is mounted to at least one of the jaws between the upper and lower grippers. The film separation device, in one embodiment, has a length equal to or greater than the width of the composite film tube 12. The film separation device is configured in one embodiment as a cutting device, such as a knife, secured to one of the opposing carriages. It should be understood that the film separation device can include other types of cutting devices including without limitation air and water jets, hot wire, die, shear, ultrasonic devices, and/or combinations thereof, positioned between the upper and lower grippers. In one embodiment, the film separation device is secured to the jaw with a quick-release mechanism, including for example and without limitation removable pins. The film separation device is laterally moveable relative to the jaw with an actuation cylinder from a cutting position to a retracted position.

In operation, and with reference to FIGS. 6, 7, 19 and 20, the carriage assembly 28 is moved in the vertical (or longitudinal) direction 30 at the same speed and velocity as the composite film tube 12. The jaws 20 are closed by moving the pivot lever 26, which drives the jaws together, with the upper and lower grippers gripping the film tube 12. The sealing devices are then moved laterally toward each other to form a cross seal as the grippers are biased against the force of the springs, thereby closing and sealing the film tube 12 as the jaws move at the same velocity as the film tube. In this way, the sealing device is moved laterally relative to the grippers.

In one embodiment, the jaws 20 have top and bottom sealing surfaces, with a film separation device, configured as a knife in one embodiment, located between the top and bottom surfaces. The film separation device fires through the film after the seal is made. The grippers may maintain a grip on the film as the film separation device is actuated in one embodiment. In an alternative embodiment, the jaws 20 may open a slight distance, for example about 10-15 mm, and move at a different velocity relative to the film tube 12 until the film separation device is aligned with the seal and the sealing device is moved out of alignment with the seal, whereinafter the the jaws 20 are then closed again. With the upper and lower grippers again gripping the film tube 12, the film separation device is actuated, for example by moving the cutting device laterally to thereby cut the film tube across the seal. Alternatively, the jaws can be closed with an extended knife so as to make the cut while moving with the film, preferably proximate the longitudinal centerline of the seal.

The film tube is filled with product 14 after a first lower seal is made and before a next upper seal is formed as shown in FIG. 20. After the film tube is filled, the next upper seal is formed to thereby form a bag of product, and the cut is made across the seal to separate the filled bag from the film tube above. The cut simultaneously forms a pair of notches 264 from the slit 262. In this way, the filled bag is sealed at the top and bottom 64, 66 thereof all of the way to the edges thereof, which edges are formed by the cut sequence. The sequence of the seal formation, carriage shift and cut may be accomplished in several alternative ways.

Figure 25:
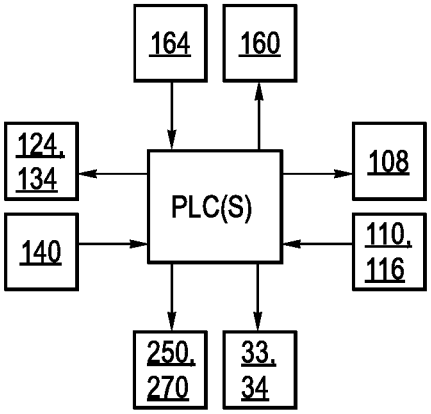
FIG. 25 is a schematic drawing of a portion of a control system.

For the entire system to operate in a continuous manner, the servo motion, including the reclosable fastener feed VFD unwind system, the flattening device, the reclosable fastener feed device, the tear notch applicator, and the sealing jaw position, are coordinated by one or more PLC (programmable logic controller) as shown for example in FIG. 25. The PLC(s) coordinate the timing of the flattening device, the tear notch applicator and the sealing jaws such that the bag transverse cutoff, the tear notch, and the reclosable fastener material weld, or flattened portion, are all aligned in the same location. When a bag with a different repeat length is desired, the PLC(s) recalculate(s) the timing of the different operations that is required achieve this colocation.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A vertical form, fill and seal machine for making a reclosable package with a reclosable fastener comprising:

a vertically oriented forming tube configured to receive a film and form a film tube;

a rotary ultrasonic horn disposed adjacent the forming tube, wherein the first rotary ultrasonic horn is rotatable about a first horizontal axis, the first rotary ultrasonic horn having a first circumferential surface;

a first rotary ultrasonic anvil disposed adjacent the forming tube, wherein the first rotary ultrasonic anvil is rotatable about a second horizontal axis, the first rotary ultrasonic anvil having a second circumferential surface disposed adjacent the first circumferential surface;

a reclosable fastener feed device disposed upstream of the forming tube, wherein the reclosable fastener feed device is configured to move a reclosable fastener material into a first nip between the rotary ultrasonic horn and the first rotary ultrasonic anvil wherein the first rotatory ultrasonic anvil and the rotary ultrasonic horn are continuously rotatable so as to continuously seal the film tube and reclosable fastener material; and a second rotary ultrasonic anvil disposed adjacent the forming tube, wherein the second rotary ultrasonic anvil is rotatable about a third horizontal axis, the second rotary ultrasonic anvil having a third circumferential surface disposed adjacent the first circumferential surface, wherein the second rotatory ultrasonic anvil and the rotary ultrasonic horn are continuously rotatable so as to continuously seal the film tube.

2. The vertical form, fill and seal machine of claim 1 wherein the reclosable fastener feed device comprises a set pulley aligned with the first nip.

3. The vertical form, fill and seal machine of claim 1 wherein the first rotary ultrasonic anvil comprises a circumferential relief formed in the circumferential surface.

4. The vertical form, fill and seal machine of claim 1 further comprising a sealing jaw assembly disposed downstream of the rotary ultrasonic horn, wherein the sealing jaw assembly comprises a pair of sealing jaws reciprocally moveable in a machine direction, wherein the pair of sealing jaws is configured to move with the film tube and fastener material, wherein the sealing jaws are movable toward and away from each other in a transverse direction, and wherein the sealing jaws are configured to form a transverse seal on the film tube and fastener material.

5. The vertical form, fill and seal machine of claim 4 wherein the flattening device comprises a horn and an anvil adapted to be positioned on opposite sides of the reclosable fastener material.

6. The vertical form, fill and seal machine of claim 1 further comprising a flattening device reciprocally moveable in a machine direction, wherein the flattening device is configured to move with the reclosable fastener material upstream of the forming tube and successively flatten the reclosable fastener material at spaced apart locations.

7. The vertical form, fill and seal machine of claim 1 further comprising a first actuator coupled to, and operative to apply a first lateral force with, the first rotary ultrasonic anvil, and a second actuator coupled to, and operative to apply a second lateral force with, the second rotary ultrasonic anvil.

8. A vertical form, fill and seal machine for making a reclosable package with a reclosable fastener comprising:

a vertically oriented forming tube configured to receive a film and form a film tube;

a rotary ultrasonic horn disposed adjacent the forming tube, wherein the first rotary ultrasonic horn is rotatable about a first horizontal axis, the rotary ultrasonic horn having a first circumferential surface;

a first rotary ultrasonic anvil disposed adjacent the forming tube, wherein the first rotary ultrasonic anvil is rotatable about a second horizontal axis, the first rotary ultrasonic anvil having a second circumferential surface disposed adjacent the first circumferential surface; and a second rotary ultrasonic anvil disposed adjacent the forming tube, wherein the second rotary ultrasonic anvil is rotatable about a third horizontal axis, the second rotary ultrasonic anvil having a third circumferential surface disposed adjacent the first circumferential surface, wherein the second and third axes are coaxial.

9. A vertical form, fill and seal machine for making a reclosable package with a reclosable fastener comprising:

a vertically oriented forming tube configured to receive a film and form a film tube;

a rotary ultrasonic horn disposed adjacent the forming tube, wherein the rotary ultrasonic horn is rotatable about a first horizontal axis, the rotary ultrasonic horn having a first circumferential surface;

a first rotary ultrasonic anvil disposed adjacent the forming tube, wherein the first rotary ultrasonic anvil is rotatable about a second horizontal axis, the first rotary ultrasonic anvil having a second circumferential surface disposed adjacent the first circumferential surface; and a second rotary ultrasonic anvil disposed adjacent the forming tube, wherein the second rotary ultrasonic anvil is rotatable about a third horizontal axis, the second rotary ultrasonic anvil having a third circumferential surface disposed adjacent the first circumferential surface; and a tear notch applicator positioned downstream of the rotary ultrasonic horn and configured to apply a plurality of slits spaced apart in the machine direction of the film tube.

10. A vertical form, fill and seal machine for making a reclosable package with a reclosable fastener comprising:

a vertically oriented forming tube configured to receive a film and form a film tube;

a rotary ultrasonic horn disposed adjacent downstream of the forming tube, wherein the rotary ultrasonic horn is rotatable about a first horizontal axis, the rotary ultrasonic horn having a first circumferential surface;

a rotary ultrasonic anvil disposed adjacent the forming tube, wherein the rotary ultrasonic anvil is rotatable about a second horizontal axis, the rotary ultrasonic anvil having a second circumferential surface disposed adjacent to the first circumferential surface and forming a nip to receive opposite edge portions of the film tube; and a reclosable fastener feed device disposed upstream of the forming tube, wherein the reclosable fastener feed device is configured to move a reclosable fastener material into the nip between opposite edges of the film tube and between the rotary ultrasonic horn and the first rotary ultrasonic anvil, and wherein the rotatory ultrasonic anvil and the rotary ultrasonic horn are continuously rotatable so as to continuously seal the film tube and reclosable fastener material.

11. The vertical form, fill and seal machine of claim 10 wherein the rotary ultrasonic anvil comprises a first rotary ultrasonic anvil and wherein the nip comprises a first nip, further comprising a second rotary ultrasonic anvil disposed adjacent the forming tube, wherein the second rotary ultrasonic anvil is rotatable about a third horizontal axis, the second rotary ultrasonic anvil having a third circumferential surface spaced apart from the first circumferential surface and forming a second nip therebetween to receive outer portions of the opposite edges of the film tube.

12. The vertical form, fill and seal machine of claim 10 wherein the reclosable fastener feed device comprises a set pulley aligned with the nip.

13. The vertical form, fill and seal machine of claim 10 further comprising a sealing jaw assembly disposed downstream of the rotary ultrasonic horn, wherein the sealing jaw assembly comprises a pair of sealing jaws reciprocally moveable in a machine direction, wherein the pair of sealing jaws is configured to move with the film tube and fastener material, wherein the sealing jaws are movable toward and away from each other in a transverse direction, and wherein the sealing jaws are configured to form a transverse seal on the film tube and fastener material.

14. The vertical form, fill and seal machine of claim 10 further comprising a flattening device reciprocally moveable in a machine direction, wherein the flattening device is configured to move with the reclosable fastener material upstream of the forming tube and successively flatten the reclosable fastener material at spaced apart locations.

15. The vertical form, fill and seal machine of claim 14 wherein the flattening device comprises a horn and an anvil adapted to be positioned on opposite sides of the reclosable fastener material.

16. The vertical form, fill and seal machine of claim 10 wherein the rotary ultrasonic anvil comprises a circumferential relief formed in the circumferential surface.

17. A vertical form, fill and seal machine for making a reclosable package with a reclosable fastener comprising:

a vertically oriented forming tube configured to receive a film and form a film tube;

a rotary ultrasonic horn disposed adjacent the forming tube, wherein the rotary ultrasonic horn is rotatable about a first horizontal axis, the rotary ultrasonic horn having a first circumferential surface;

a rotary ultrasonic anvil disposed adjacent the forming tube, wherein the rotary ultrasonic anvil is rotatable about a second horizontal axis, the rotary ultrasonic anvil having a second circumferential surface disposed adjacent to the first circumferential surface and forming a nip to receive opposite edge portions of the film tube;

a reclosable fastener feed device disposed upstream of the forming tube, wherein the reclosable fastener feed device is configured to move a reclosable fastener material into the nip between opposite edges of the film tube and between the rotary ultrasonic horn and the first rotary ultrasonic anvil; and a tear notch applicator positioned downstream of the rotary ultrasonic horn and configured to apply a plurality of slits spaced apart in the machine direction of the film tube.

18. A vertical form, fill and seal machine for making a reclosable package with a reclosable fastener comprising:

a vertically oriented forming tube configured to receive a film and form a film tube;

a first rotary ultrasonic horn disposed adjacent the forming tube, wherein the first rotary ultrasonic horn is rotatable about a first horizontal axis, the first rotary ultrasonic horn having a first circumferential surface;

a first rotary ultrasonic anvil disposed adjacent the forming tube, wherein the first rotary ultrasonic anvil is rotatable about a second horizontal axis, the first rotary ultrasonic anvil having a second circumferential surface disposed adjacent the first circumferential surface and forming a first nip therebetween;

a second rotary ultrasonic horn disposed downstream of the first rotary ultrasonic horn, wherein the second rotary ultrasonic horn is rotatable about a third horizontal axis, the second rotary ultrasonic horn having a third circumferential surface; and a second rotary ultrasonic anvil disposed downstream of the first rotary ultrasonic anvil, wherein the second rotary ultrasonic anvil is rotatable about a fourth horizontal axis, the second rotary ultrasonic anvil having a fourth circumferential surface disposed adjacent the third circumferential surface and forming a second nip therebetween wherein the second rotatory ultrasonic anvil and the second rotary ultrasonic horn are continuously rotatable so as to continuously seal the film tithe.

19. The vertical form, fill and seal machine of claim 18 further comprising a recloseable fastener feed device disposed upstream of the forming tube, wherein the recloseable fastener feed device is configured to move a recloseable fastener material into the first nip between the first rotary ultrasonic horn and the first rotary ultrasonic anvil, and wherein the first rotatory ultrasonic anvil and the first rotary ultrasonic horn are continuously rotatable so as to continuously seal the recloseable fastener material and film tube.

20. The vertical form, fill and seal machine of claim 18 further comprising a sealing jaw assembly disposed downstream of the first and second rotary ultrasonic horns, wherein the sealing jaw assembly comprises a pair of sealing jaws reciprocally moveable in a machine direction, wherein the pair of sealing jaws is configured to move with the film tube and fastener material, wherein the sealing jaws are movable toward and away from each other in a transverse direction, and wherein the sealing jaws are configured to form a transverse seal on the film tube and fastener material.

21. The vertical form, fill and seal machine of claim 18 further comprising a first actuator coupled to, and operative to apply a first lateral force with, the first rotary ultrasonic anvil, and a second actuator coupled to, and operative to apply a second lateral force with, the second rotary ultrasonic anvil.

* * * * *